US012472398B2

(12) United States Patent
Manula

(10) Patent No.: US 12,472,398 B2
(45) Date of Patent: Nov. 18, 2025

(54) MASTER TRAINER

(71) Applicant: Cyril Gerard Manula, Dallas, TX (US)

(72) Inventor: Cyril Gerard Manula, Dallas, TX (US)

( * ) Notice: Subject to any disclaimer, the term of this patent is extended or adjusted under 35 U.S.C. 154(b) by 0 days.

(21) Appl. No.: 17/300,957

(22) Filed: Dec. 27, 2021

(65) Prior Publication Data

US 2025/0222297 A1 Jul. 10, 2025

(51) Int. Cl.
*A63B 21/00* (2006.01)

(52) U.S. Cl.
CPC ..... *A63B 21/154* (2013.01); *A63B 21/00058* (2013.01); *A63B 21/152* (2013.01); *A63B 2225/09* (2013.01); *A63B 2225/107* (2013.01)

(58) Field of Classification Search
CPC ..... A63B 21/00058; A63B 21/00069; A63B 21/062; A63B 21/0626; A63B 21/0628; A63B 21/063; A63B 21/152; A63B 21/154; A63B 21/156; A63B 21/4035; A63B 21/4047; A63B 2225/09; A63B 2225/093; A63B 2225/107
See application file for complete search history.

(56) References Cited

U.S. PATENT DOCUMENTS

| | | | | |
|---|---|---|---|---|
| 4,603,855 | A * | 8/1986 | Sebelle | A63B 21/06 482/133 |
| 4,898,381 | A * | 2/1990 | Gordon | A63B 23/03533 482/103 |
| 5,725,459 | A * | 3/1998 | Rexach | A63B 23/03566 482/92 |
| 6,447,430 | B1 * | 9/2002 | Webb | A63B 23/00 482/93 |
| 7,169,093 | B2 * | 1/2007 | Simonson | A63B 21/156 482/138 |
| 8,727,952 | B1 * | 5/2014 | Carle | A63B 21/0628 482/99 |
| 10,737,139 | B2 * | 8/2020 | Walker | A63B 21/4049 |
| 11,229,822 | B1 * | 1/2022 | Manula | A63B 21/4047 |
| 2002/0091043 | A1 * | 7/2002 | Rexach | A63B 21/0628 482/99 |
| 2007/0054785 | A1 * | 3/2007 | Drechsler | A63B 21/156 482/94 |
| 2007/0161472 | A1 * | 7/2007 | Drechsler | A63B 21/4045 482/99 |
| 2009/0170675 | A1 * | 7/2009 | Giannelli | A63B 21/156 482/139 |
| 2020/0139187 | A1 * | 5/2020 | Kennington | A63B 71/0622 |

* cited by examiner

*Primary Examiner* — Gary D Urbiel Goldner

(57) ABSTRACT

Systems and devices for a master trainer for a master trainer having independent press arms with rotating pulley systems each with attached carriages that allows for the press arms and pulley systems and carriages to be adjustable to different heights in order to perform various exercises. Additionally, the master trainer is configured to be used with or without a bench with an adjustable back and seat and is configured to allow for varying exercises to be performed based on the height of the carriage system and adjustment of the bench.

21 Claims, 38 Drawing Sheets

Assembly 600

Assembly 600

Assembly 600

Assembly 650

Assembly 650

Assembly 650

Assembly 700

Assembly 700

Assembly 700

Assembly 750

Assembly 750

Assembly 750

Assembly 90

Assembly 100

Assembly 250

Assembly 300

Assembly 400

Assembly 400

Assembly 400

Assembly 400

Assembly 400

Assembly 400

Assembly 500

Assembly 500

Assembly 500

Assembly 500

Assembly 500

Assembly 500

MASTER TRAINER

FIELD OF INVENTION

This invention relates to fitness machines, and in particular to systems, devices and methods for a master trainer having independent inwardly converging press arms each containing a pulley and cable system attached to a carriage system that allows for the press arms and carriages to be adjustable to different heights in order to perform exercises with or without a bench with an adjustable back and seat. The master trainer can be used individually or in combination with a bench with an adjustable back and seat to allow for various exercises to be performed based on the height of the arms and attached pulley cable system and carriage systems and adjustment of the bench.

BACKGROUND AND PRIOR ART

Cable machines have been used over the years where a user can either stand or sit and/or be positioned between two pulley systems, where various resistance amounts can be chosen by either adding weight or subtracting various weights from the weight stack systems. The cable pulley system can be push, pulled and/or pressed in a variety of directions.

To date the carriage system used for adjustable cable machines (called functional trainers and cable crossovers) do not contain independent converging press arms that greatly increases the function of the unit. Traditionally the carriage system on functional trainers and cable cross over machines only contain a pulley system that allows for either pushing, pulling and/or pressing exercise movements. This allows for no exercise variation for functional trainers and cable crossover machines. Additionally, the carriage systems on functional trainers and cable crossover machines do not contain a counter weight system for neutralizing the weight of the carriage. Thus, the need exists for solutions to the above problems with the prior art.

SUMMARY OF THE INVENTION

A primary objective of the present invention is to provide systems, devices and methods for a master trainer having Independent inwardly converging press arms each containing a rotating pulley and cable system attached to height adjustable carriages and accompanying foot rotating pulley and cable system that allows for the press arms to be adjustable to different heights in order to perform various exercises.

A secondary objective of the present invention is to provide systems, devices and methods for a master trainer having independent inwardly converging press arms each containing a rotating pulley and cable system attached to height adjustable carriages and accompanying foot rotating pulley and cable system and a bench (bench is free and not attached to master trainer) with an adjustable back and seat allowing for various exercises to be performed based on the height of the carriage systems and adjustment of the bench.

A third objective of the invention is to provide systems, devices and methods for a master trainer having independent inwardly converging press arms each containing a rotating pulley and cable system attached to height adjustable carriages and accompanying foot rotating pulley and cable system, with the ability to limit the range of motion of the desired exercise being performed.

A fourth objective of the present invention is to provide systems, devices and methods for a master trainer having independent inwardly converging press arms each containing a rotating pulley and cable system attached to height adjustable carriages and accompanying foot rotating pulley and cable system, where the depth of the exercise movements can be controlled by adjusting the carriages to limit the motions of the desired exercise.

A fifth objective of the present invention is to provide systems, devices and methods for a master trainer having independent inwardly converging press arms each containing a rotating pulley and cable system attached to height adjustable carriages and accompanying foot rotating pulley and cable system, which helps in injury prevention and/or injury rehabilitation.

A sixth objective of the present invention is to provide systems, devices and methods for a master trainer having independent inwardly converging press arms each containing a rotating pulley and cable system each attached to height adjustable carriages and accompanying foot rotating pulley and cable system, which allows for doing partial exercise repetitions to help gain additional strength before transitioning into full ranges of motion.

A seventh objective of the present invention is to provide systems, devices and methods for a master trainer having independent inwardly converging press arms each containing a rotating pulley and cable system each attached to height adjustable carriages and accompanying foot rotating pulley and cable system which maximizes the number of exercises that can be performed within a fixed amount of floor space.

An eighth objective of the present invention is to provide systems, devices and methods for a master trainer having independent inwardly converging press arms each containing a rotating pulley and cable system each attached to height adjustable carriages and accompanying foot rotating pulley and cable system which adds pressing, pulling and pushing exercises among others either with or without a bench with an adjustable back and seat which allow various pressing movements to be performed among others based on the height of the inwardly converging press arms and a pulley and cable system attached to height adjustable carriages.

A ninth objective of the present invention is to provide systems, devices and methods for a master trainer having inwardly converging press arms each containing a rotating pulley and cable system each attached to height adjustable carriages and accompanying foot rotating pulley and cable system which allows for the cable system to be used across multiple planes of motion.

A tenth objective of the present invention is to provide systems, devices and methods for a master trainer having independent inwardly converging press arms each containing a rotating pulley and cable system attached to height adjustable carriages and accompanying foot rotating pulley and cable system which allows for multiple individuals to perform exercises on the fitness machine simultaneously.

An eleventh objective of the present invention is to provide systems, devices and methods for a master trainer having independent inwardly converging press arms each containing a rotating pulley and cable system attached to height adjustable carriages and accompanying foot rotating pulley and cable system which is attached to a counter weight system designed to eliminate the weight of the press arms, arm pulley systems and carriage systems.

Further objectives and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

DESCRIPTION OF THE PREFERRED EMBODIMENTS

Figure 1:
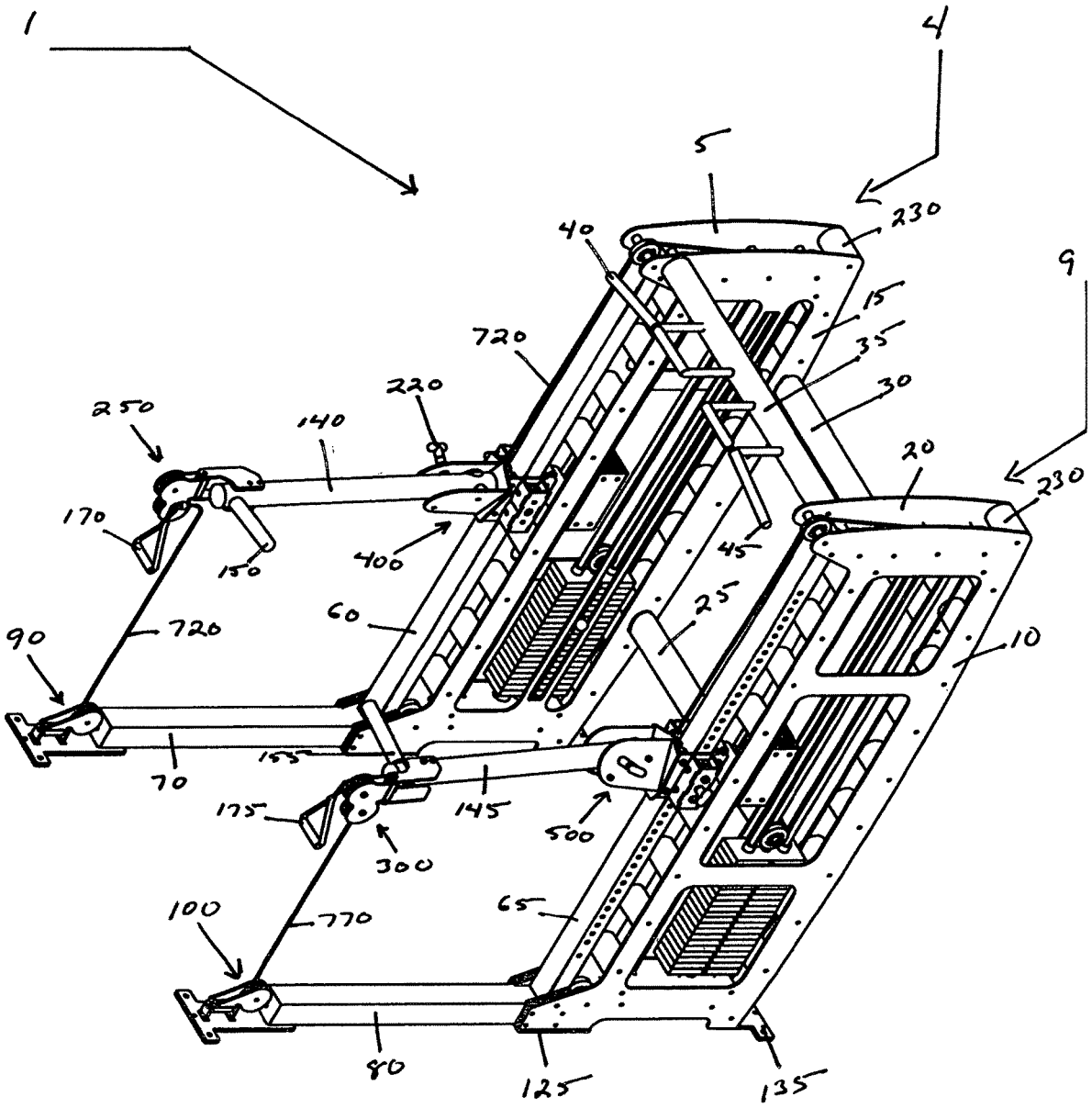
FIG. 1 is an upper front right perspective view of the fitness machine with independently height adjustable inwardly converging press arms and rotating pulley system

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the summary above and in the Detailed Description of the Preferred Embodiments and in the accompanying drawings, reference is made to particular features (including method steps) of the invention. It is to be understood that the disclosure of the invention in this specification. does not include all the possible combinations of such particular features. For example, where a particular feature is disclosed in the context of a particular aspect or embodiment of the invention, that feature can also be used, to the extent possible, in combination with and/or in the context of other particular aspects and embodiments of the invention and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete and will convey the scope of the invention to those skilled in the art. Like numbers refer to like elements throughout and prime notation is used to indicate similar elements in alternative embodiments.

A LIST OF COMPONENTS WILL NOW BE DESCRIBED

1. fitness machine
4. left main frame
5. left outwardly facing frame
9. right main frame
10. right outwardly facing frame
15. left inwardly facing frame
20. right inwardly facing frame
25. lower rear main frame connector
30. upper rear main frame connector
35. upper front main frame connector
40. far left outwardly facing handle
45. far right outwardly facing handle
50. middle left outwardly facing handle
55. middle right outwardly facing handle
60. left selector tube
61. left selector hole(s)
65. right selector tube
66. right selector hole(s)
70. left leg
80. right leg
90. left foot rotating pulley assembly
91. left foot pulley plate
92. left foot front pulley bracket
93. left foot rear pulley bracket
94. left foot pulley holder
95. left foot bearing/bushing hub
96. left foot pulley shaft
97. left foot pulley bearing/bushing
98*a*. left foot shaft fastener bolt
98*b*. left foot pulley fastener bolt
98*c*. left foot pulley fastener nut
98*d*. left foot leg fastener bolt
98*e*. left foot leg fastener nut
99. left foot pulley
100. right foot rotating pulley assembly
101. right foot pulley plate
102. right foot front pully bracket
103. right foot rear pulley bracket
104. right foot pulley holder
105. right foot bearing/bushing hub
106. right foot pulley shaft
107. right foot pulley bearing/bushing
108*a*. right foot shaft fastener bolt
108*b*. right foot pulley fastener bolt
108*c*. right foot pulley fastener nut
108*d*. right foot leg fastener bolt
108*e*. right foot leg fastener nut
109. right foot pulley
120. left middle foot
125. right middle foot
130. left rear foot
135. right rear foot
140. left converging press arm
145. right converging press arm
150. left inwardly facing arm handle
155. right inwardly facing arm handle
170. left arm cable handle
175. right arm cable handle
215. carriage spring loaded pin
220. arm spring loaded locking pin
225. spring loaded carabiner clip
230. main frame spacer tube(s)
250. left arm rotating pulley assembly
251. top left pulley bracket
252. top left pulley bracket spacer
253. bottom left pulley bracket
254. bottom left pulley bracket spacer
255. left arm pulley holder
256. left arm pulley bearing/bushing hub
257. left arm pulley shaft
258. left arm pulley bearing/bushing
259. left arm top pulley
260. left arm bottom pulley
261. left arm shaft fastener bolt
262. left arm top pulley fastener bolt
263. left arm top pulley fastener nut
264. left arm bottom pulley fastener bolt
265. left arm bottom pulley fastener nut
266. left arm pulley bracket fastener bolt
267. left arm pulley bracket fastener nut
300. right arm rotating pulley system
301. top right pulley bracket
302. top right pulley bracket spacer
303. bottom right pulley bracket.
304. bottom right pulley bracket spacer
305. right arm pulley holder
306. right arm pulley bearing/bushing hub
307. right arm pulley shaft
308. right arm pulley bearing/bushing
309. right arm top pulley
310. right arm bottom pulley
311. right arm shaft fastener bolt
312. right arm top pulley fastener bolt
313. right arm top pulley fastener nut
314. right arm bottom pulley fastener bolt
315. right arm bottom pulley fastener nut
316. right arm pulley bracket fastener bolt
317. right arm pulley bracket fastener nut
400. left movable carriage assembly
405. left front carriage plate
407. left front carriage cable tab
410. left outwardly facing carriage plate
415. left Inwardly facing carriage plate

420. left outwardly facing press arm plate
425. left inwardly facing press arm plate
430. left outwardly facing bearing box
435. left Inwardly facing bearing box
440. upper main bearing wheel assembly
441. shaft
442. first wheel
443. second wheel
445. lower main bearing wheel assembly
446. shaft
447. first wheel
448. second wheel
450. left outwardly facing side bearing wheel assembly
451. shaft
452. first wheel
453. second wheel
455. left inwardly facing side bearing wheel assembly
456. shaft
457. first wheel
458. second wheel
460. left outwardly facing carriage plate upper counter weight cable tab
465. left inwardly facing carriage plate upper counter weight cable tab
470. left outwardly facing carriage plate lower counter weight cable tab
475. left Inwardly facing carriage plate lower counter weight cable tab
480. left press arm outer pivot point location
485. left press arm inner pivot point location
490. left arm stopper
492. left press arm stopper fastener bolt
493. left press arm stopper outer location
495. left press arm stopper inner location
497. left arm pivot pin
498. side bearing tensioning bolt
499. shaft fastener bolt
500. right movable carriage assembly
505. right front carriage plate
507. right front carriage plate cable tab
510. right outwardly facing carriage plate
515. right inwardly facing carriage plate
520. right outwardly facing press arm plate
525. right inwardly facing press arm plate
530. right outwardly facing bearing box
535. right inwardly facing bearing box
540. upper main bearing wheel assembly
541. shaft
542. first wheel
543. second wheel
545. lower main bearing wheel assembly
546. shaft
547. first wheel
548. second wheel
550. right outwardly facing side bearing wheel assembly
551. shaft
552. first wheel
553. second wheel
555. right Inwardly facing side bearing wheel assembly
556. shaft
557. first wheel
558. second wheel
560. right outwardly facing carriage plate upper counter weight cable tab
565. right inwardly facing carriage plate weight upper counter weight cable tab
570. right outwardly facing carriage plate lower counter weight cable tab,
575. right inwardly facing carriage plate lower counter weight cable tab
580. right press arm outer pivot point location
585. right press arm inner pivot point location
590. right press arm stopper
592. right press arm stopper fastener bolt
593. right press arm stopper outer location
595. right press arm stopper inner location
597. right press arm pivot pin
598. side bearing tensioning bolt
599. shaft fastener bolt
600. left carriage counter weight assembly
605. left counter weight
610. pulley
615. pulley
620. pulley
625. pulley
630. left primary counter weight cable
631. adjustable cable loop
632. adjustable cable loop
633. adjustable cable loop
634. adjustable cable loop
635. left secondary counter weight cable
636. cable spacer
637. cable fastener bolt
640. left upper counter weight bracket
645. left lower counter weight bracket
650. right carriage counter weight assembly
655. right counter weight
660. pulley
665. pulley
670. pulley
675. pulley
680. right primary counter weight cable
681. adjustable cable loop
682. adjustable cable loop
683. adjustable cable loop
684. adjustable cable loop
685. right secondary counter weight cable
686. cable spacer
687. cable fastener bolt
690. right upper counter weight bracket
695. right lower counter weight bracket
700 left weight stack assembly
705. weight stack
707. selector pin
710. weight stack pulley
715. weight stack pulley bracket
720. left weight stack cable
721. weight stack cable adjustable loop
722. weight stack cable end loop
724. weight stack cable stopper
725. guide rode
730. guide rod
735. top guide plate
740. bottom guide plate
742. pulley
744. pulley
746. pulley
748. pulley
750. right weight stack assembly
755. weight stack
757. selector pin
760. weight stack pulley
765. weight stack pulley bracket

770. right weight stack cable
771. weight stack cable adjustable loop
772. weight stack cable end loop
774. cable stopper
775. guide rod
780. guide rod
785. top guide plate
790. bottom guide plate
792. pulley
794. pulley
796. pulley
798. pulley Before any explanation of the figures, it is important to note that the frame construction style employed in these descriptions is a based on just one design style and does not indicate the only frame style that can house this invention and is in no way intended to limited these designs to one singular build style. Independent arms, height adjustable carriages, carriage counter weights, rotating pulley locations and weight stack/resistance cable function are the primary features of this design and can be achieved in a number of different frame build styles.

Figure 2:
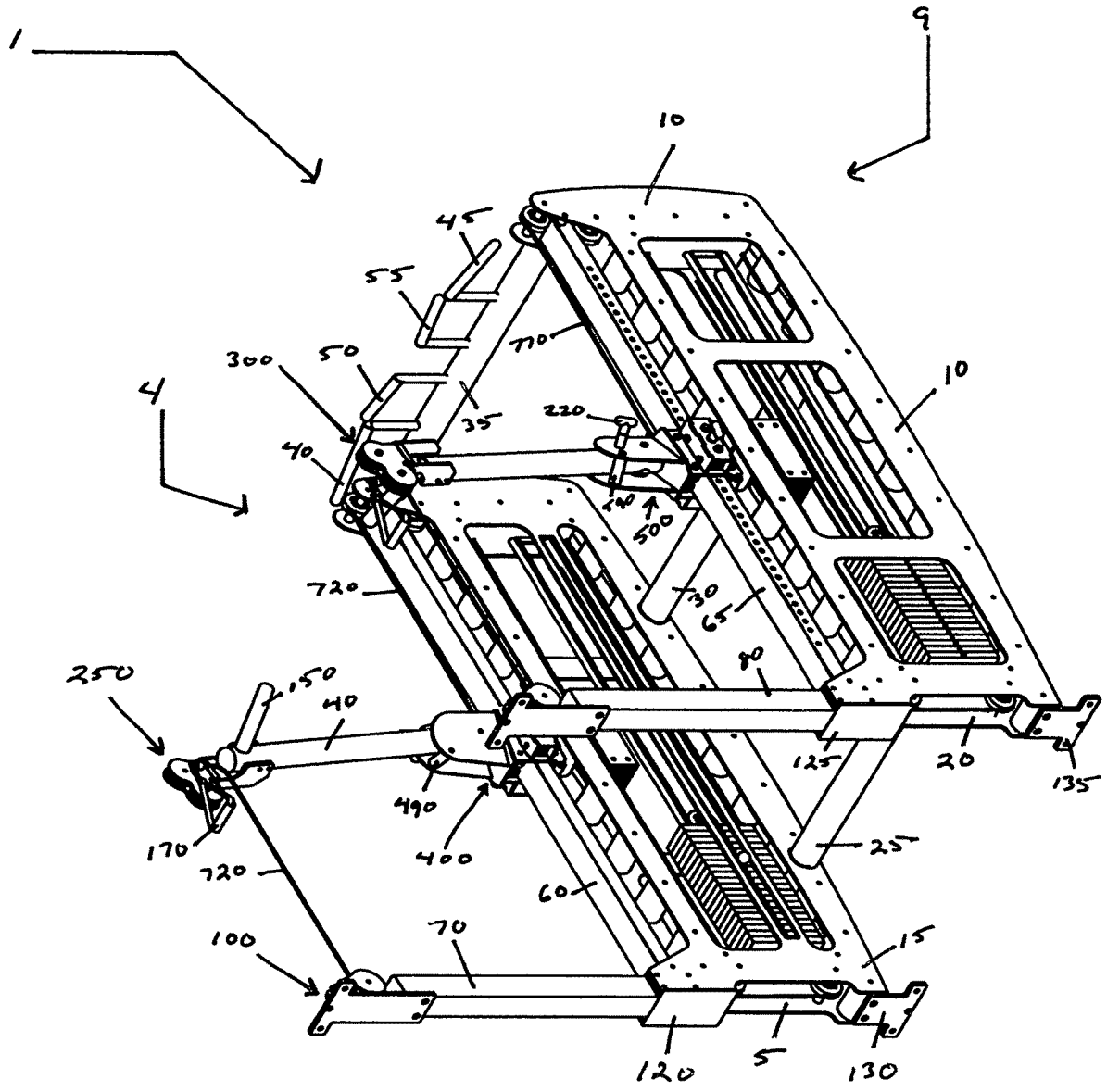
FIG. 2 is a lower front right perspective view of the fitness machine of FIG. 1.
Figure 3:
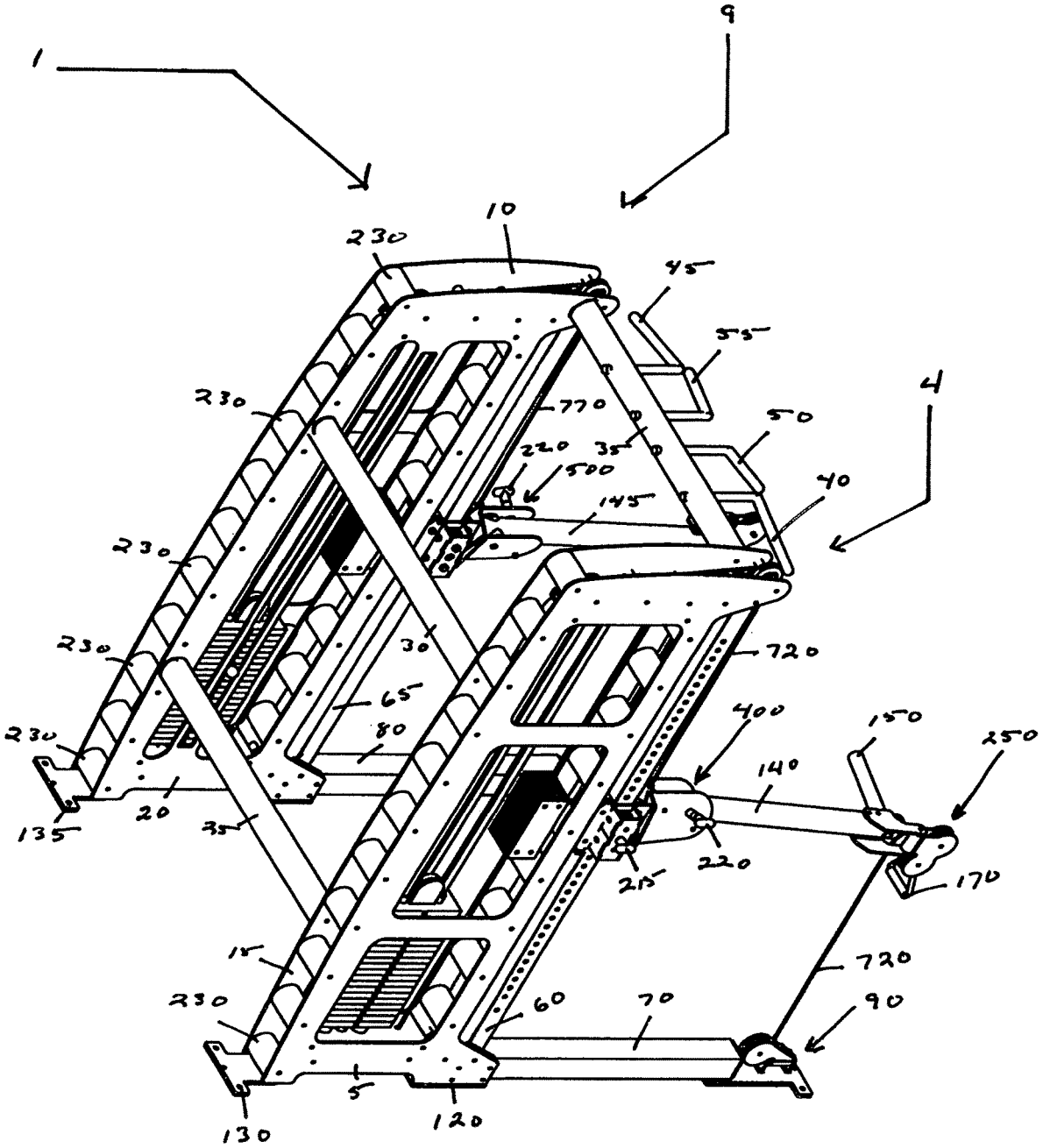
FIG. 3 is an upper rear left perspective view of the fitness machine of FIG. 1
Figure 4:
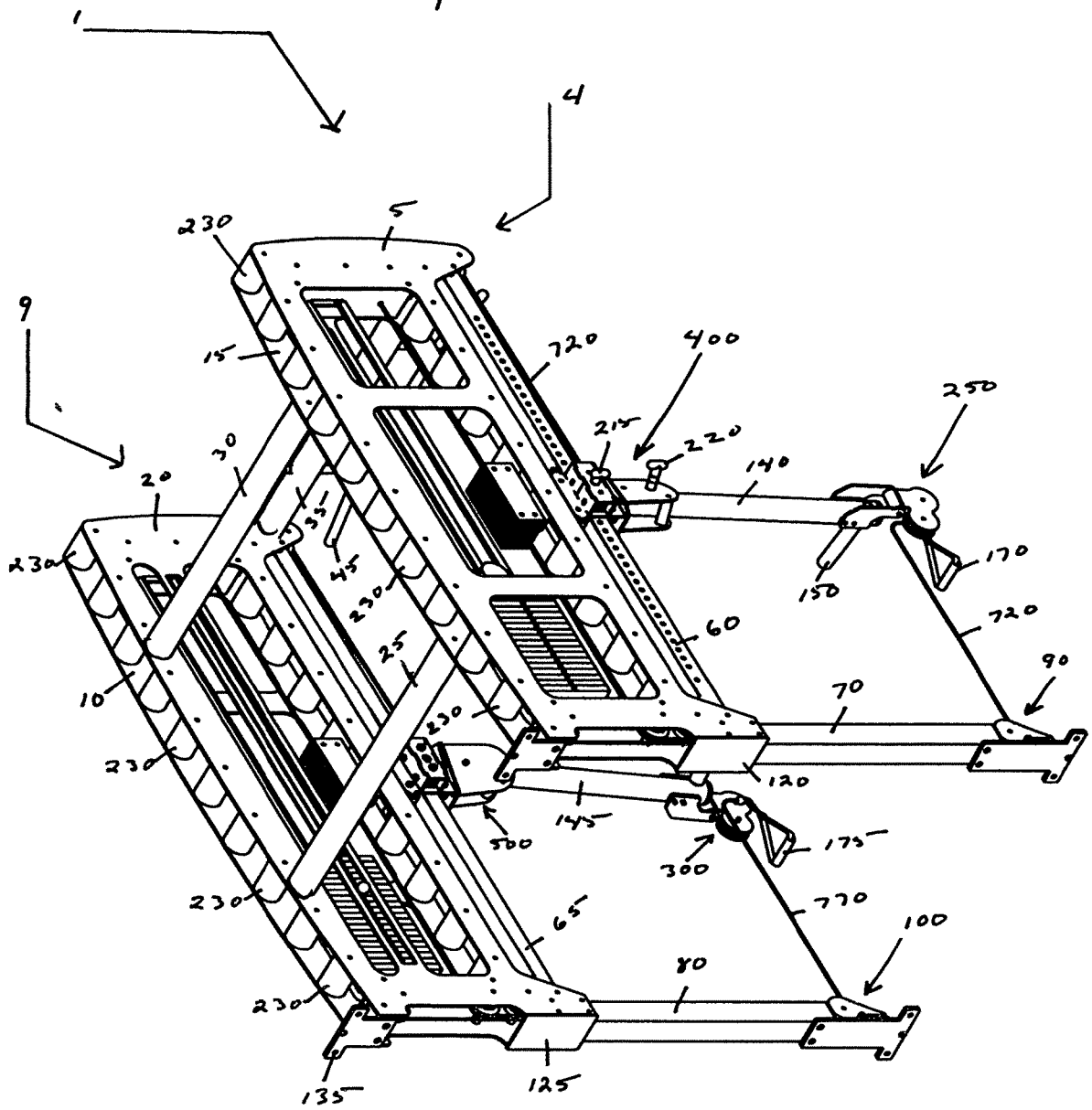
FIG. 4 is a lower rear left perspective view of the fitness machine of FIG. 1
Figure 5:
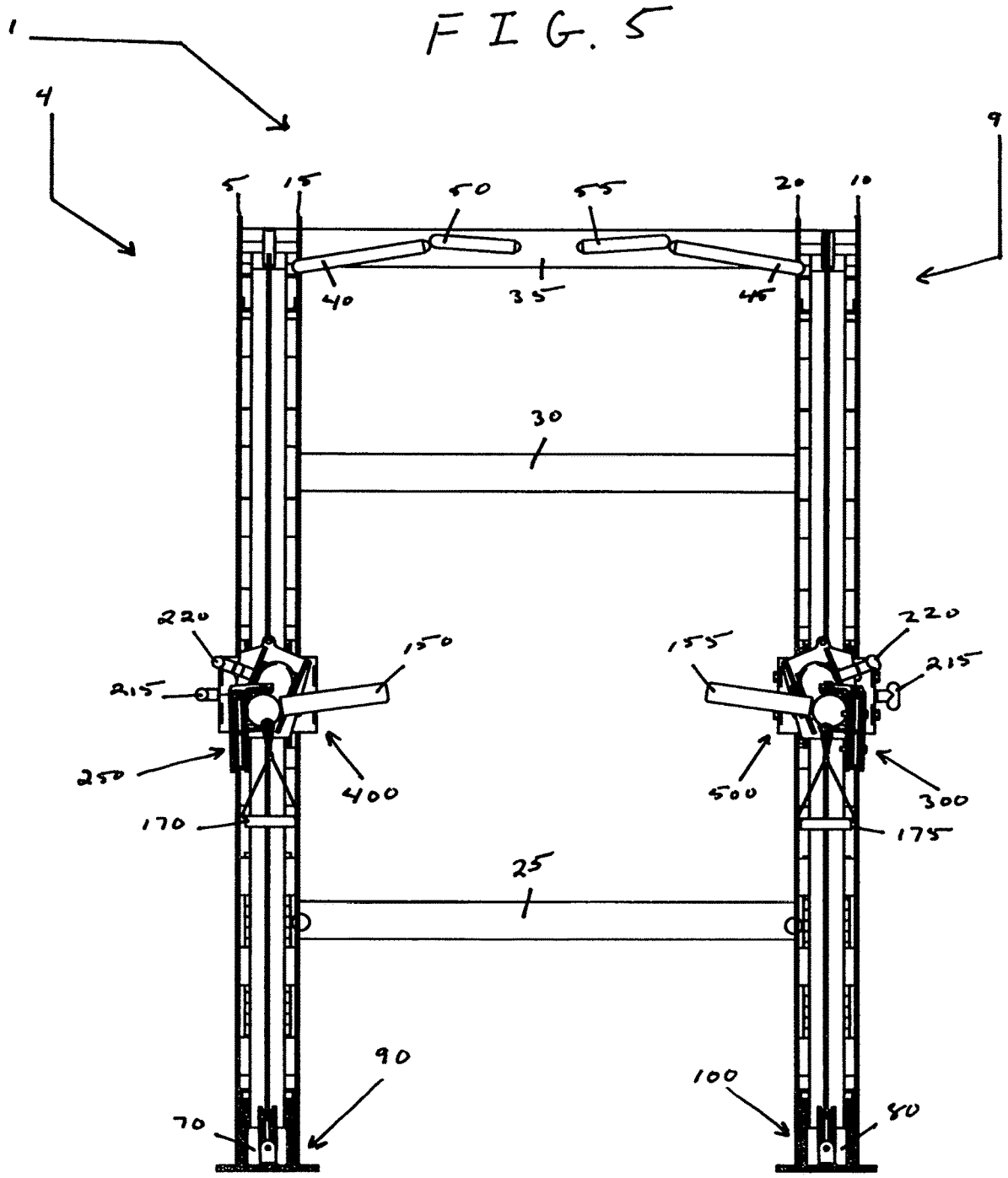
FIG. 5 is a front view of the fitness machine in FIG. 1
Figure 6:
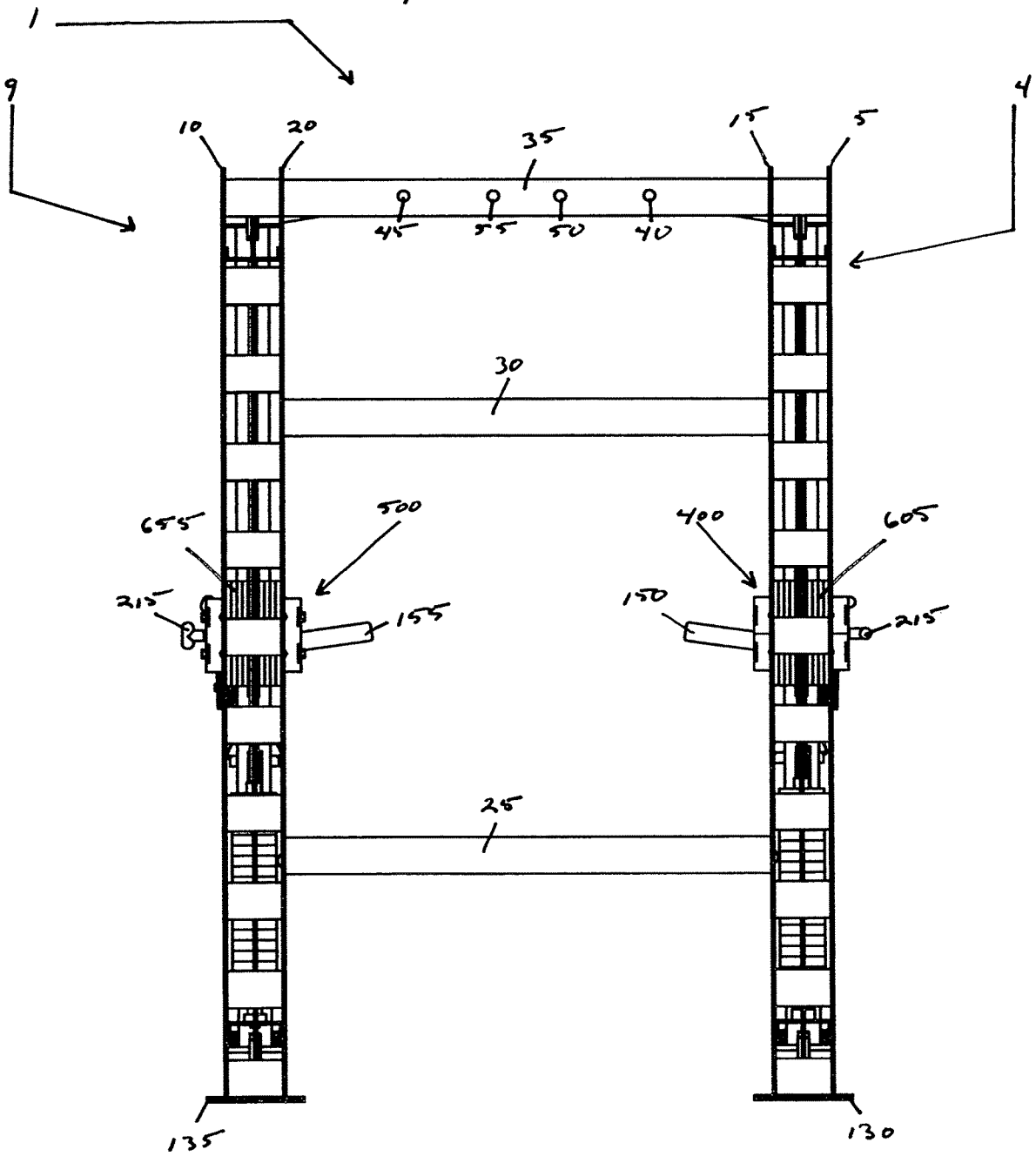
FIG. 6 is a back view of the fitness machine of FIG. 1
Figure 7:
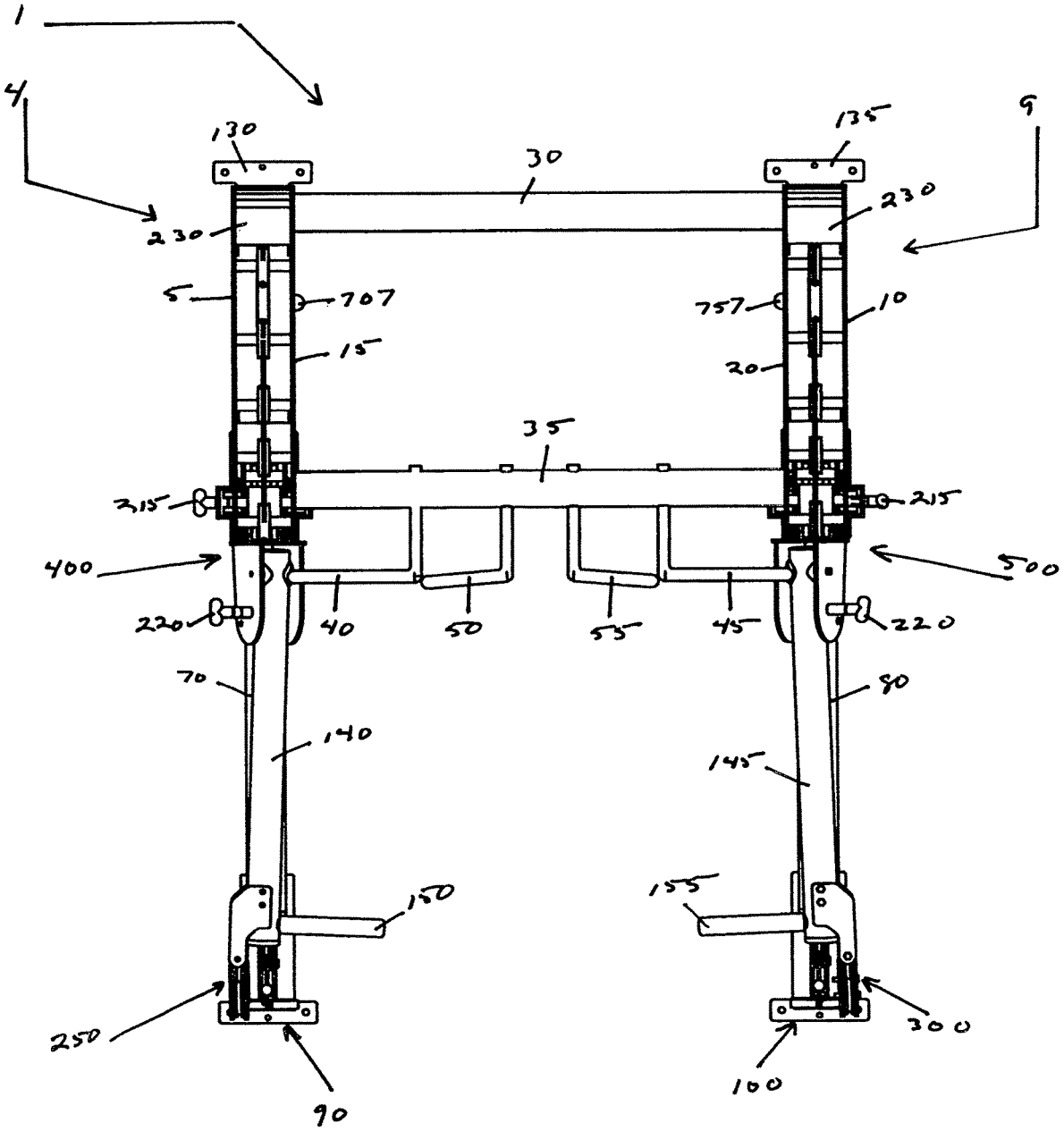
FIG. 7 is a top view of the fitness machine of FIG. 1
Figure 8:
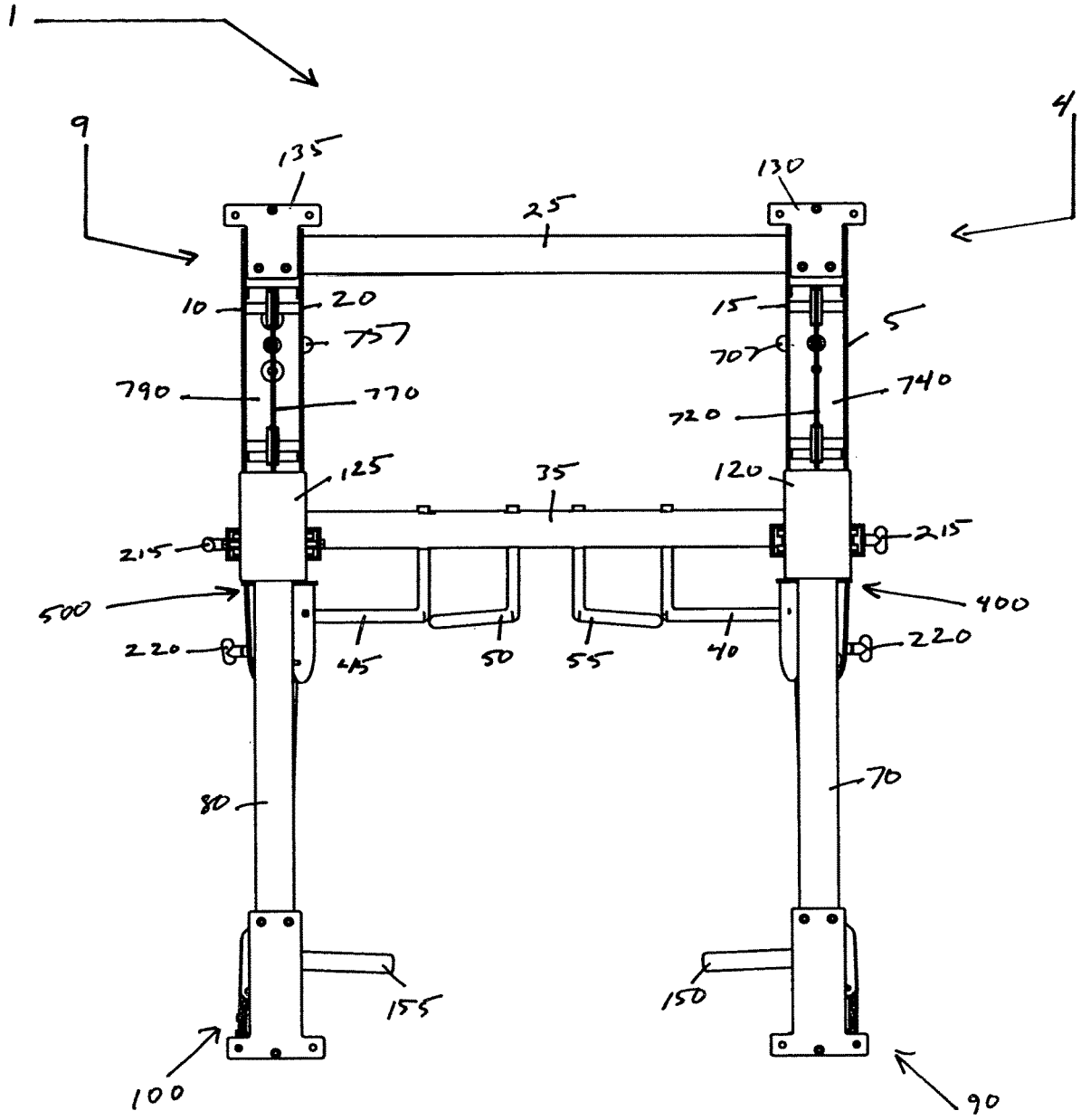
FIG. 8 is a bottom view of the fitness machine of FIG. 1
Figure 9:
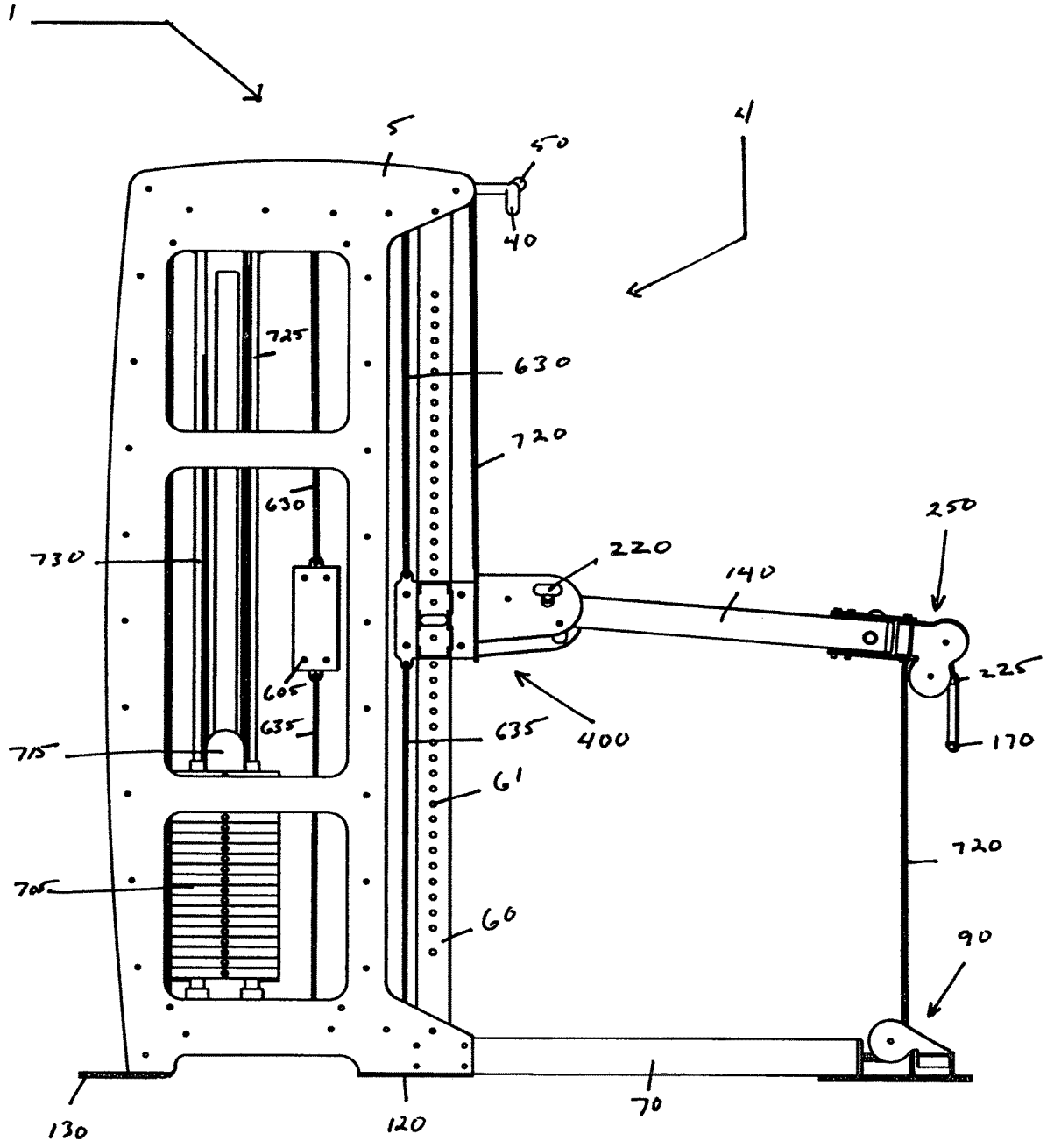
FIG. 9 is a left view of the fitness machine of FIG. 1
Figure 10:
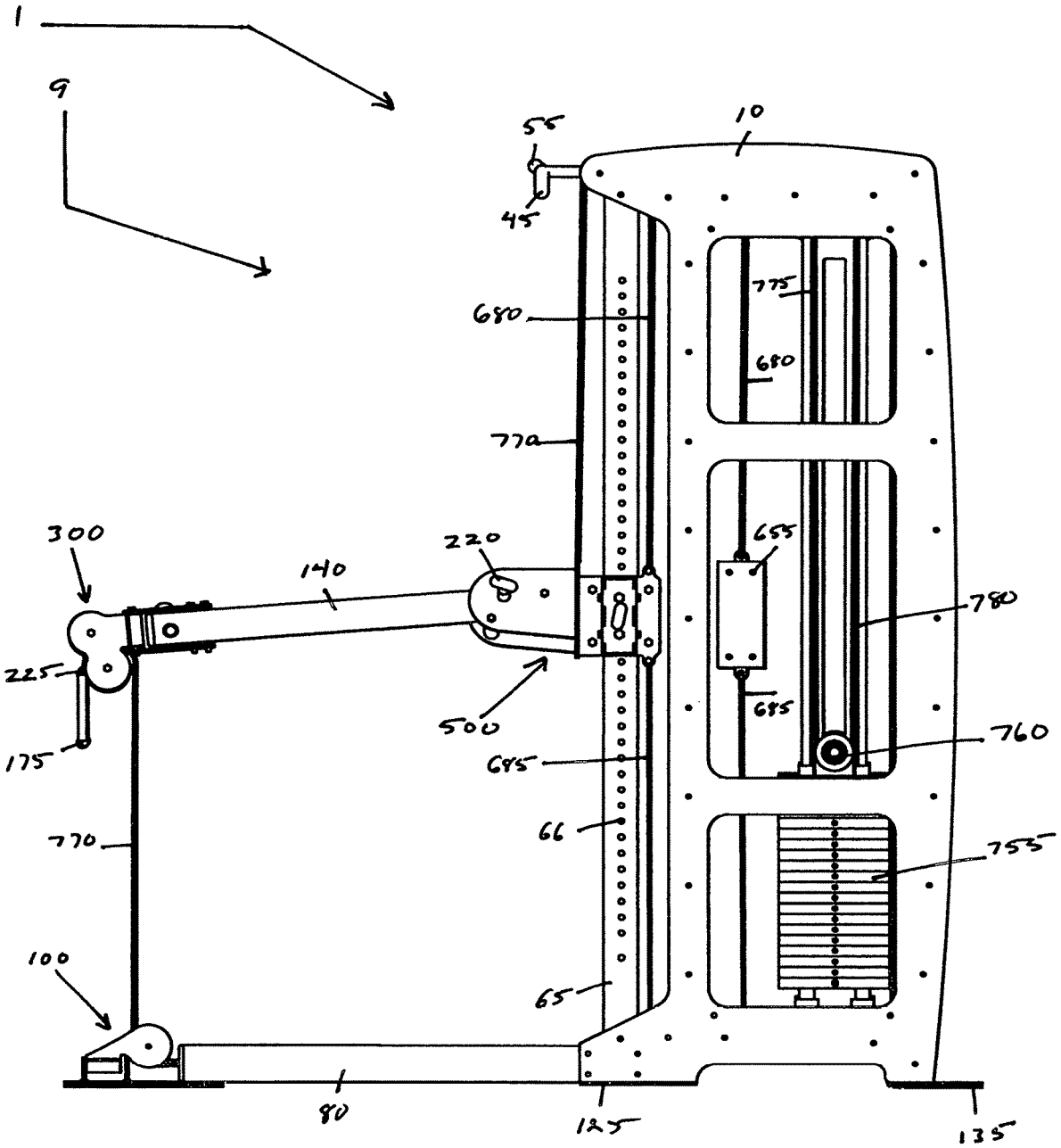
FIG. 10 is a right view of the fitness machine of FIG. 1

FIG. 1 is an upper front right perspective view of the fitness machine 1 with main frame 4 having an independent upwardly pivoting left converging press arm 140 with left arm rotating pulley assembly 250, weight stack cable 720 and left leg 70 with a fixably attached left foot rotating pulley assembly 90 and parallel placed main frame 9 connected to main frame 4, by parallelly placed lower rear main frame connector 25, upper rear main frame connector 30 and upper front main frame connector 35, having an independent height adjustable upwardly pivoting right converging press arm 145 with right arm rotating pulley assembly 300, weight stack cable 770 and right leg 80 with a fixably attached right foot rotating pulley assembly 100. FIG. 2 is a lower front right perspective view of the fitness machine of FIG. 1. FIG. 3 is an upper rear right perspective view of the fitness machine of FIG. 1. FIG. 4 is a lower rear right perspective view of the fitness machine of FIG. 1. FIG. 5 is a front view of the fitness machine of FIG. 1. FIG. 6 is a back view of the fitness machine of FIG. 1. FIG. 7 is a top view of the fitness machine of FIG. 1. FIG. 8 is a bottom view of the fitness machine of FIG. 1. FIG. 9 is a left view of the fitness machine of FIG. 1. FIG. 10 is a right view of the fitness machine of FIG. 1.

Referring to FIGS. 1-10, the fitness machine 1' can include a left main frame 4 having a left outwardly facing frame 5 and a left inwardly facing frame 15 separated by and parallelly attached by main frame spacer tube(s) 230.

Left main frame 4 can have a fixably attached left side horizontal leg 70 having a fixably attached left foot rotating pulley assembly 90 (which will be described later).

Left main Frame 4 can further include a fixably attached left middle foot 120 and a fixably attached left rear foot 130.

Spaced between left outwardly facing frame 5 and left inwardly facing frame 15 can be a fixably attached left selector tube 60.

Spaced along the outwardly facing side of left selector tube 60 can be a vertical series of left selector holes 61 (which will be described later) for vertically locating the left movable carriage assembly 400.

Selector tube 60 can have a vertically moveable carriage assembly 400 (which will be described later) with a rotationally attached upwardly pivoting left converging press arm 140.

Left converging press arm 140 can have a fixed inwardly facing handle 150 which can be used for pressing left converging arm 140 upward.

Left converging press arm 140 can further include on the outwardly facing end a fixably attached left arm rotating pulley assembly 250 (which will be described later).

Positioned between left outwardly facing frame 5 and left inwardly facing fame 15 within main frame 4 can be a left weight stack assembly 700. Left arm rotating pully assembly 250 can be connected to the left foot rotating pulley assembly 90 by way of weight stack cable 720. Weight stack cable 720 follows a series of weight stack pulleys 710, 742, 744, 746 and 748 located between left outwardly facing frame 5 and left inwardly facing frame 15 within left main frame 4.

Weight stack cable 720 connects the left arm rotating pulley assembly 250, left converging arm 140, left foot rotating pulley assembly 90 and movable carriage assembly 400 to weight stack 705. Weight stack 705, weight stack cable 720 and weight stack pulleys 710, 742, 744, 746 and 748 are located between left outwardly facing frame 5 and left inwardly facing frame 15 within left main frame 4 (weight stack assembly 700 will be described in detail later).

Positioned between left outwardly facing frame 5 and left inwardly facing frame 15 within main frame 4 can be a left carriage counter weight assembly 600. Left carriage counter weight assembly 600 can include left counter weight 605, left counter weight pulleys 610, 615, 620 and 625 and left primary counter weight cable 630 and left secondary counter weight cable 635 (left carriage counter weight assembly 600 will be described later).

Right main frame 9 can have a right outwardly facing frame 10 and a right inwardly facing frame 20 separated by and parallelly attached by main frame spacer tube(s) 230.

Right main frame 9 can have a fixably attached right horizontal leg 80 having a fixably attached right foot rotating pulley assembly 100 (which will be described later).

Right main frame 9 can further include a fixably attached right middle foot 125 and a fixably attached right rear foot 135.

Spaced between the right outwardly facing frame 10 and the right inwardly facing frame 20 can be a fixably attached selector tube 65. Spaced along the right outwardly facing side of selector tube 65 can be a vertical series of right selector holes 66 (which will be described later) for vertically locating the right movable carriage assembly 500.

Selector tube 65 can have a moveable right carriage assembly 500 (which will be described later) with a rotationally attached upwardly pivoting right converging press arm 145. Right converging press arm 145 can have a fixably attached inwardly facing handle 155 which can be used for pressing the right converging press arm 145 upward.

Right converging press arm 145 can further Include, on the outwardly facing end, a fixably attached right arm rotating pulley assembly 300 (which will be described later).

Right arm rotating pulley assembly 300 can be connected to right foot rotating pulley assembly 100 by way of weight stack cable 770. Weight stack cable 770 follows a series of weight stack pulleys 760, 790, 792, 794 and 796 which can be located between right outwardly facing frame 10 and right inwardly facing frame 20 within right main frame 9.

Weight stack cable 770 connects the right arm rotating pulley system 300, right converging arm 145, right foot rotating pulley assembly 100 and right moveable carriage assembly 500 to weight stack 755. Weight stack 755 can be located between right outwardly facing frame 10 and right inwardly facing frame 20 within right main frame 9 (right weight stack assembly 750 will be described later).

Positioned between right outwardly facing frame 10 and right inwardly facing frame 20 within main frame 9 can be a right carriage counter weight assembly 650. Right carriage counter weight assembly 650 can include a right counter weight 655, right counter weight pulleys 660, 665, 670 and 675, right primary counter weight cable 680 and right secondary counter weight cable 685 (right carriage counter weight assembly 650 will be described later).

Left main frame 4 and right main frame 9 can be fixably attached to the opposing ends of parallel spaced lower rear main frame connector 25, upper rear main frame connector 30, and upper front main frame connector 35. When fixably attached to lower rear main frame connector 25, upper rear main frame connector 30 and upper front main frame connector 35 main frame 4 and main frame 9 can be in a fixed parallel position.

Upper front main frame connector 35 can have fixably attached far left outwardly facing handle 40, fixably attached far right outwardly facing handle 45, fixably attached middle left outwardly facing handle 50 and fixably attached middle right outwardly facing handle 55.

Figure 11:
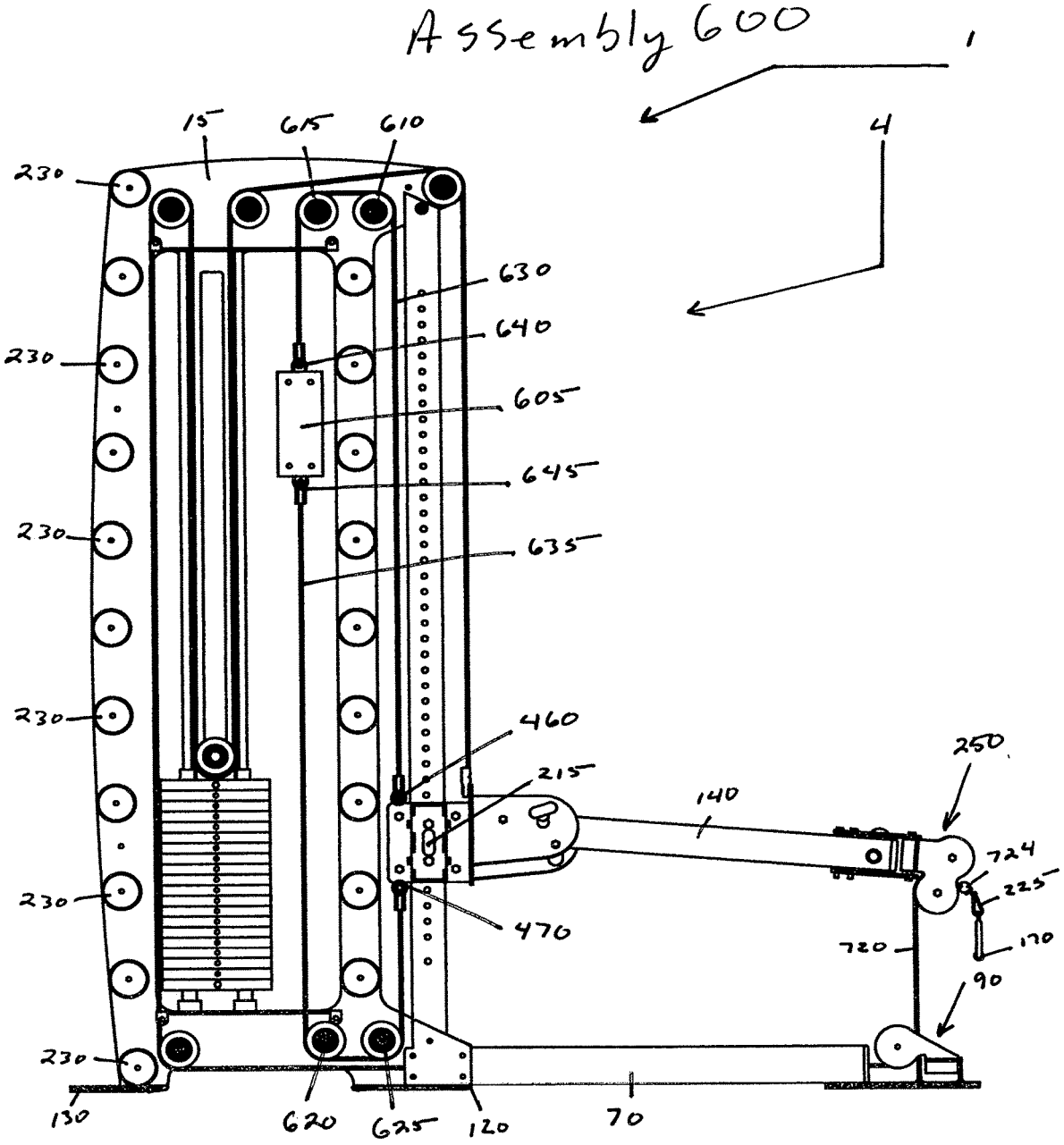
FIG. 11 left carriage counter weight assembly 600 is a left view of main frame 4 of fitness machine of FIG. 1 with left outwardly facing frame (5) removed with arm (140) at a lower position and counter weight (605) at a higher position FIG. 12 left carriage counter weight assembly 600 is a left view of main frame 4 of fitness machine of FIG. 1 with left outwardly facing frame (5) removed with arm (140) at a middle position and counter weight (605) at a middle position FIG. 13 left carriage counter weight assembly 600 is a left view of main frame 4 of fitness machine of FIG. 1 with left outwardly facing frame (5) removed with arm (140) at a higher position and counter weight assembly (605) at a lower position FIG. 14 right carriage counter weight assembly 650 is a right view of main frame 9 of fitness machine of FIG. 1 with right outwardly facing frame (10) removed with arm (145) at a lower position and counter weight (655) at a higher position FIG. 15 right carriage counter weight assembly 650 is a right view of main frame 9 of fitness machine of FIG. 1 with right outwardly facing frame (10) removed with arm (145) at a middle position with counter weight (655) at a middle position FIG. 16 right carriage counter weight assembly 650 is a right view of main frame 9 of fitness machine of FIG. 1 with right outwardly facing frame (10) removed with arm (145) at a higher position and counter weight (655) at a lower position FIG. 17 left weight stack assembly 700 is a left view of main frame 4 of fitness machine of FIG. 1 with left outwardly facing frame (5) removed FIG. 18 left weight stack assembly 700 is a left view of main frame 4 of fitness machine of FIG. 1 with left outwardly facing frame removed (5) with arm (140) at a middle position pivoting upward and weight stack (705) moving upward FIG. 19 left weight stack assembly 700 is a left view of main frame 4 of fitness machine of FIG. 1 with left outwardly facing frame removed (5) with arm (140) locked at a middle position with spring loaded locking pop pin (220) with cable handle (170) attached to spring loaded carabiner clip (225) and weight stack cable (720) with cable handle (170) being moved outward from arm pulley assembly (250) and weight stack (705) moving upward FIG. 20 right weight stack assembly 750 is a right view of main frame 9 of fitness machine of FIG. 1 with right outwardly facing frame (10) removed FIG. 21 right weight stack assembly 750 is a right view of main frame 9 of fitness machine of FIG. 1 with right outwardly facing frame removed (10) with arm (145) at a middle position pivoting upward with weight stack (755) moving upward FIG. 22 right weight stack assembly 750 is a right view of main frame 9 of fitness machine of FIG. 1 with right outwardly facing main frame removed (10) with arm (145) locked at middle position with spring loaded locking pop pin (220) with cable handle (175) attached to spring loaded carabiner clip (225) and weight stack cable (770) with cable handle (175) being moved outward from arm pulley assembly (300) and weight stack (755) moving upward
Figure 12:
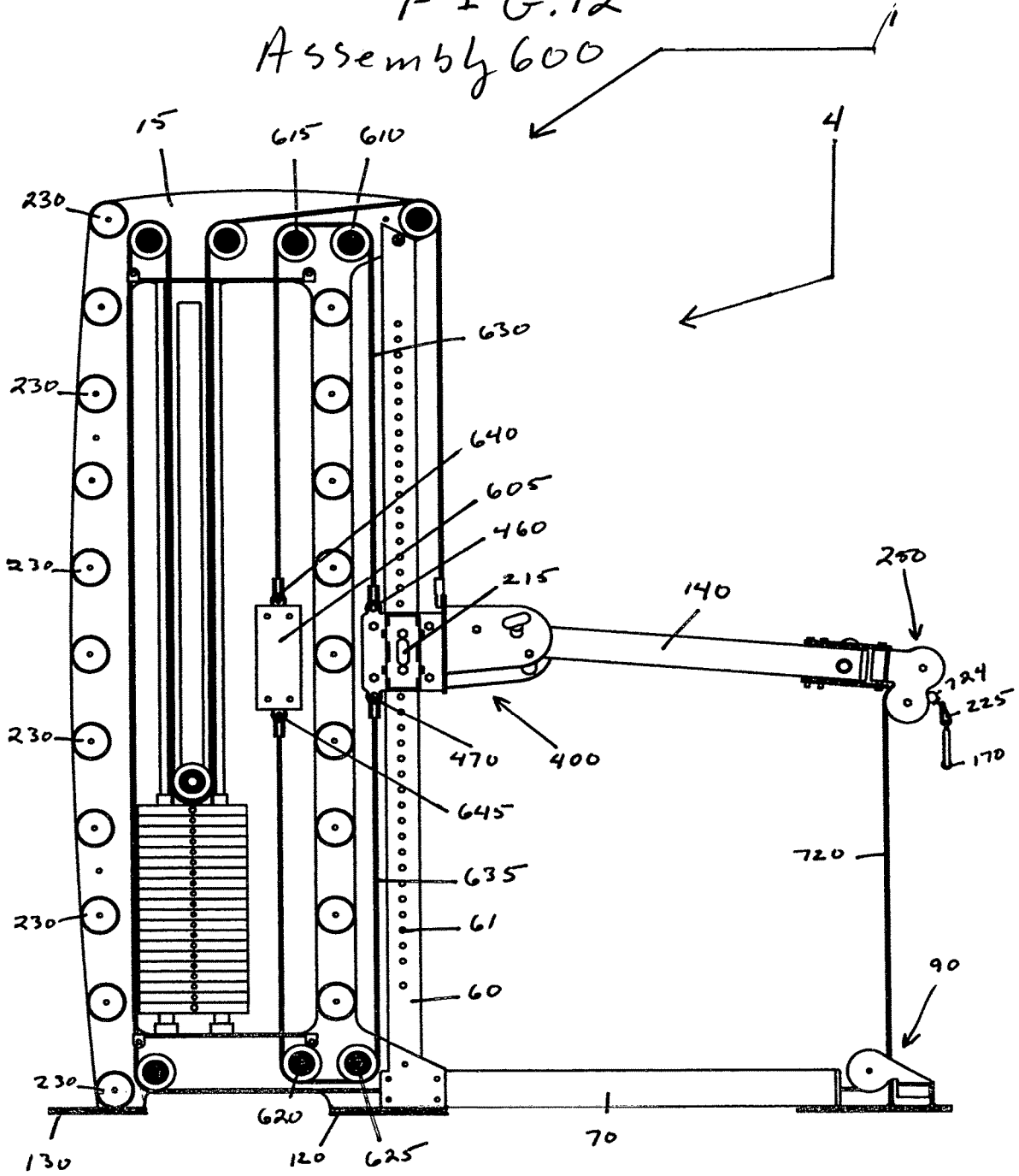
Figure 13:
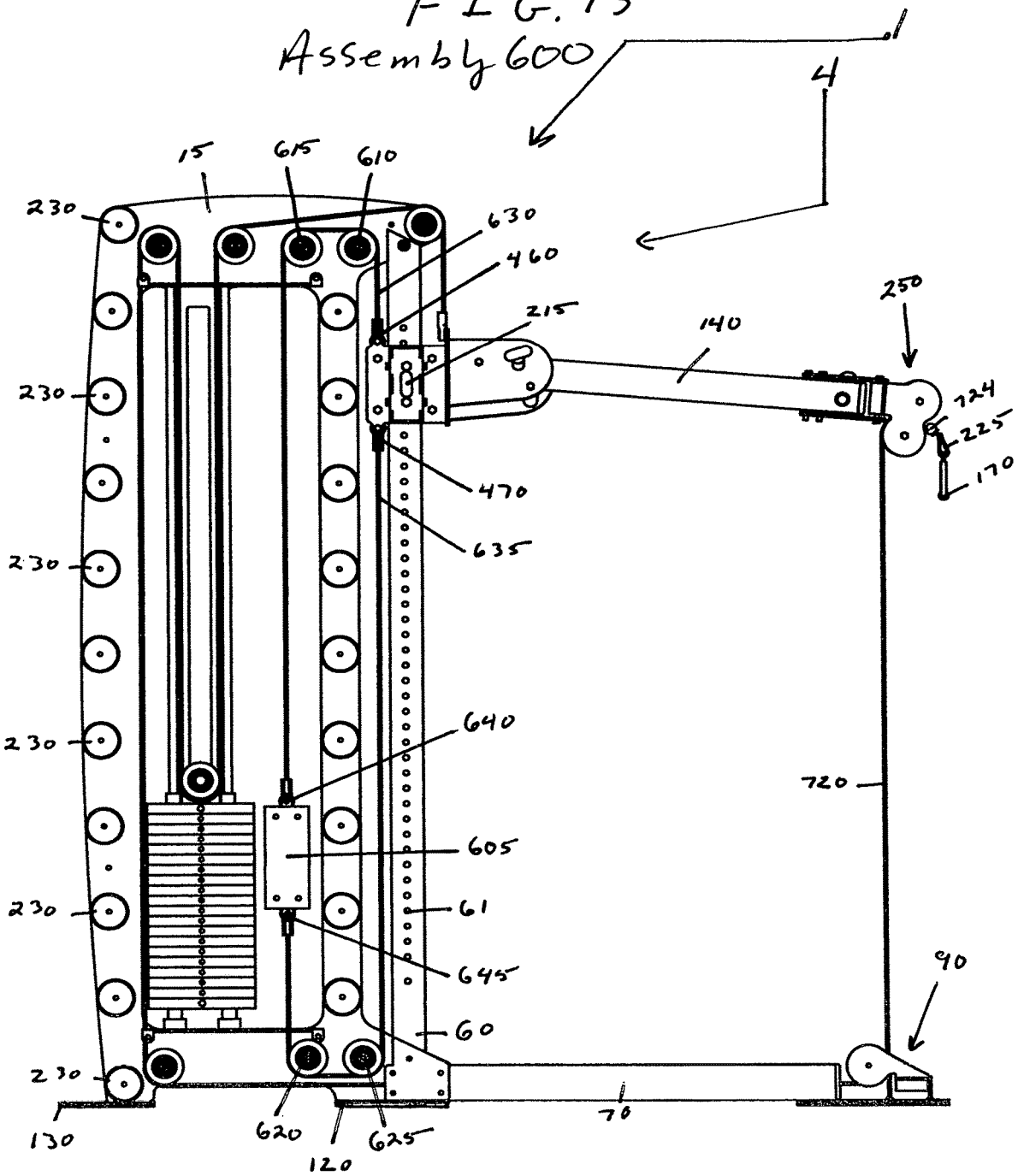

FIGS. 11-13 refer to Assembly 600 of the fitness machine of FIG. 1. Enlarged left view of left main frame 4 with left outwardly facing frame 5 removed to reveal the left counter weight assembly 600. Left main frame 4 can have pulley 610 rotationally attached between left outwardly facing frame 5 and left inwardly facing frame 15. Pulley 610 can be positioned above left moveable carriage assembly 400. Left primary counter weight cable 630 can have a fixably attached adjustable cable loop 631 and can be centered with cable spacers 636 and fixable attached between left outwardly facing upper carriage plate counter weight tab 460 and left inwardly facing upper carriage plate counter weight tab 465. Pulley 615 can be rotationally attached behind pulley 610 and above left counter weight 605. Left primary counter weight cable 630 can ascend vertically to front edge of pulley 610, horizontally from top edge of pulley 610 to top edge of pulley 615 then descend vertically from back edge of pulley 615 to left counter weight 605 where it can be fixably attached to left upper counter weight bracket 640 through adjustable cable loop 632. Additionally, left main frame 4 can have pulley 620 rotationally attached between left outwardly facing frame 5 and left inwardly frame 15. Pulley 620 can be positioned below left movable carriage assembly 400. Left secondary counter weight cable 635 can have a fixably attached adjustable cable loop 633 and can be centered with cable spacers 636 and fixably attached between left outwardly facing carriage plate lower counter weight tab 470 and left inwardly facing carriage plate lower counter weight tab 475. Pulley 625 can be rotationally attached behind pulley 620 and under counter weight 605. Left secondary counter weight cable 635 can descend vertically to front edge of pulley 620, horizontally from bottom edge of pulley 620 to bottom edge of pulley 625 then ascend vertically from back edge of pulley 625 to left counter weight 605 where it can be fixably attached to left counter weight bracket 645 through adjustable cable loop 634. Left carriage counter weight assembly 600 can allow for near weightless vertical adjustments of left movable carriage system 400, left converging press arm 140 and left arm rotating pulley system 250. Height adjustments of left movable carriage 400, left converging press arm 140 and left arm rotating pulley system 250 can be achieved by pulling spring loaded pin 215 and moving carriage vertically on left selector tube 60. Release spring loaded pin 215 at desired carriage height into selector tube hole(s) 61.

Important: Counter weight assembly 600 can be utilized in both weight stack designed fitness machines as well as weight plate loaded strength training fitness machines.

FIGS. 11-13 of fitness machine of FIG. 1 as the left movable carriage assembly 400 is vertically adjusted the left counter weight assembly 600 moves an equal distance in the opposite direction neutralizing the weight of the left movable carriage assembly 400, left converging arm 140 and left arm rotating pulley assembly 250.

Figure 14:
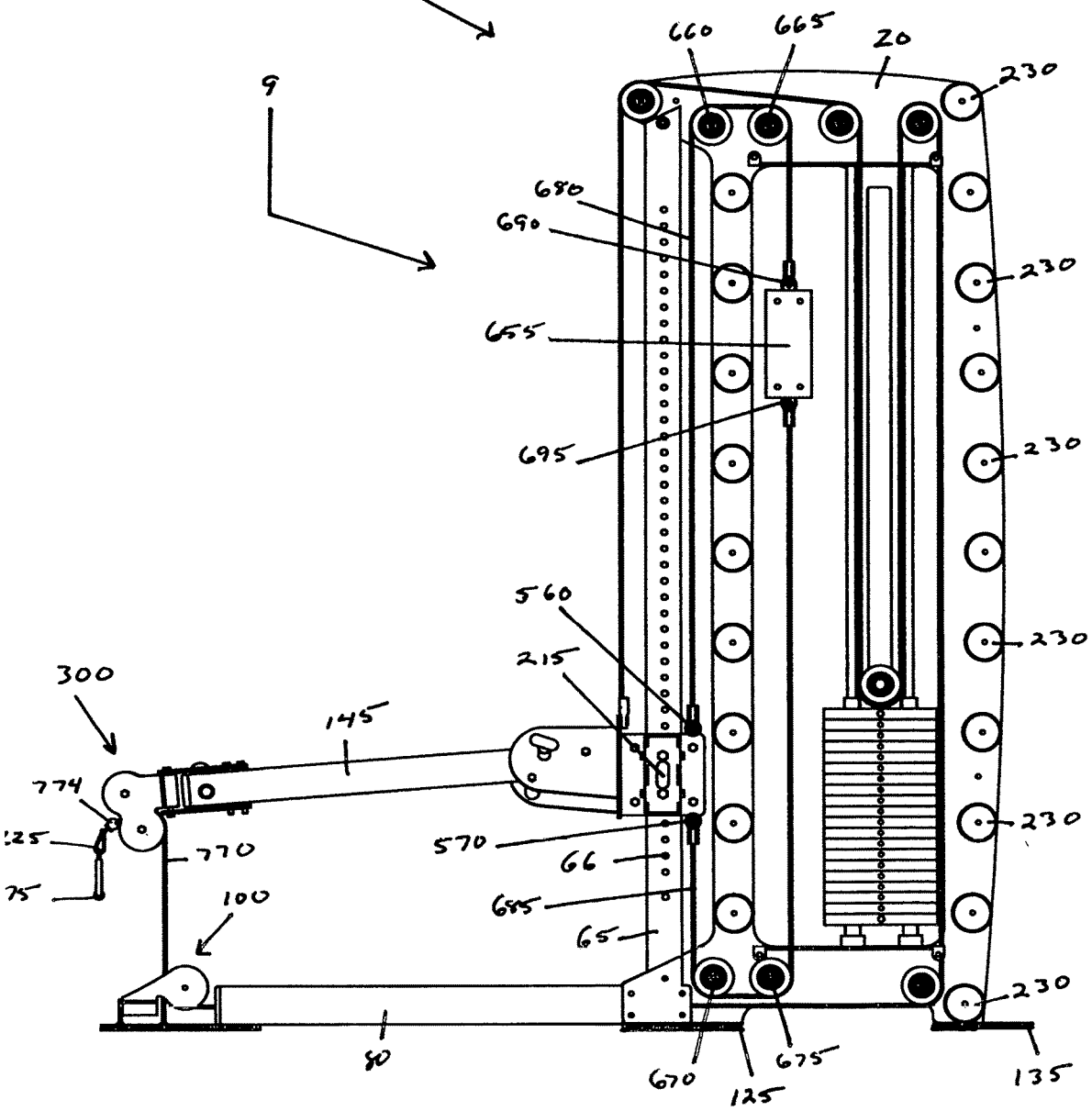
Figure 15:
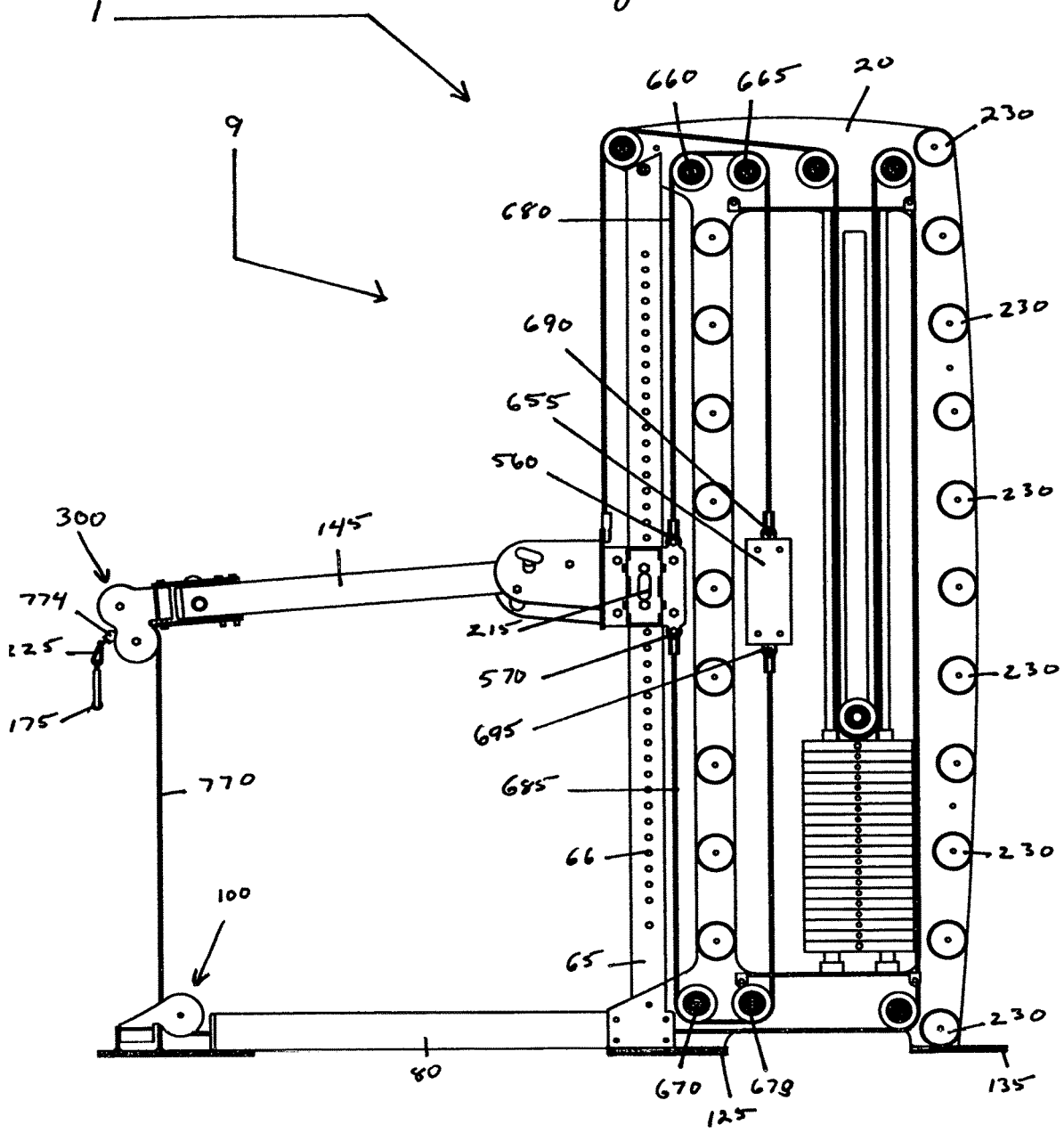
Figure 16:
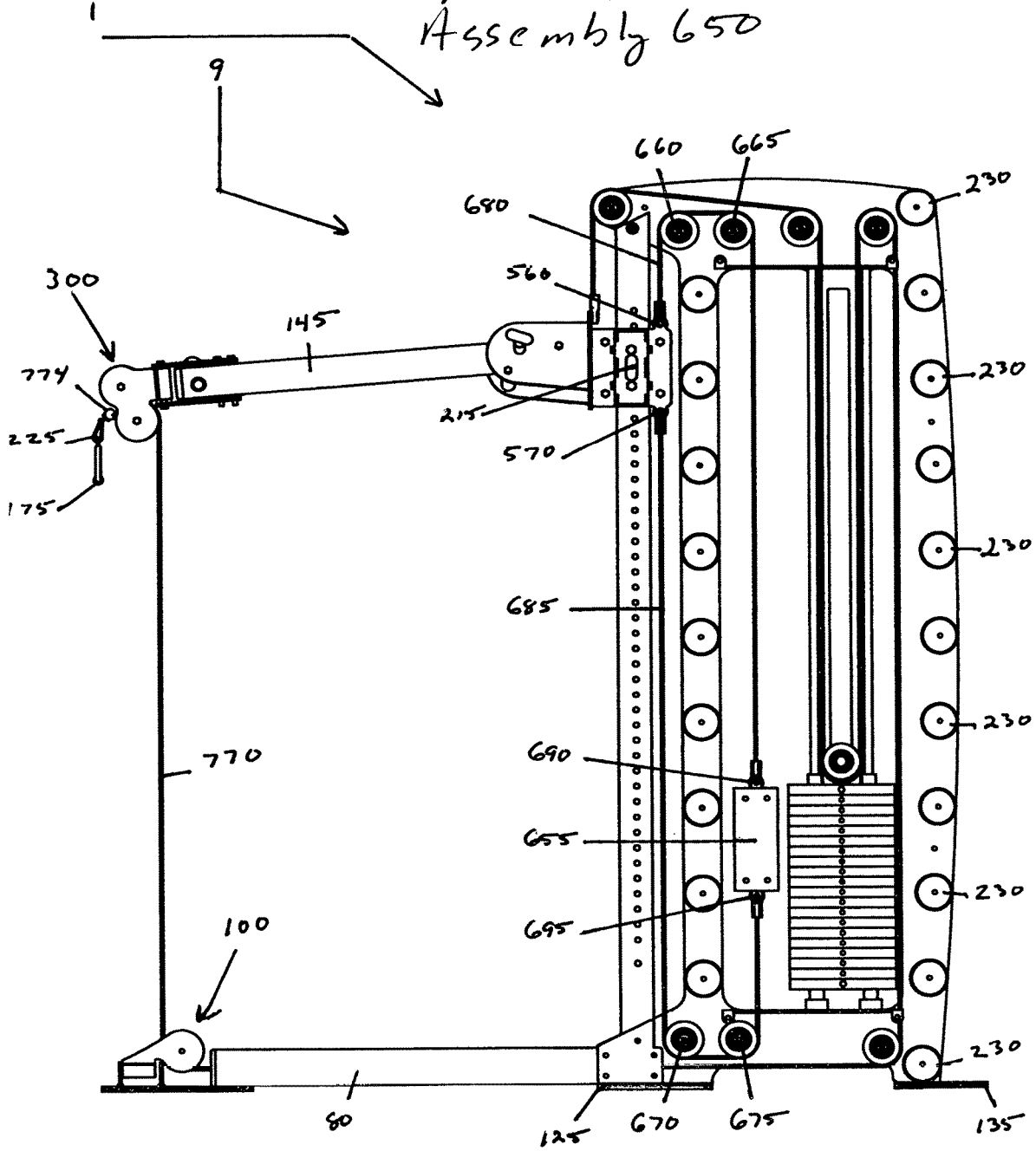

FIG. 14-16 refer to assembly 650 of the fitness machine 1 of FIG. 1 is an enlarged right view of main frame 9 with outwardly facing frame 10 removed to reveal right carriage counter weight assembly 650. Pulley 660 can be rotationally attached between right outwardly facing frame 10 and right inwardly facing frame 20. Pulley 660 can be positioned above right movable carriage assembly 500. Right primary counter weight cable 680 can have a fixably attached adjustable cable loop 681 and can be centered with cable spacers 686 and fixably attached between right outwardly facing carriage plate upper counter weight cable tab 560 and right inwardly facing carriage plate upper counter weight cable tab 565. Pulley 665 can be rotationally attached behind pulley 660 and above right counter weight 655. Right primary counter weight cable 680 can ascend vertically to front edge of pulley 660, horizontally from top edge of pulley 660 to top edge of pulley 665 then descend vertically from back edge of pulley 665 to counter weight 655 where it can be fixably attached through adjustable cable loop 682 to right upper counter weight bracket 690. Pulley 670 can be rotationally attached between right outwardly facing frame 10 and right inwardly facing frame 20. Pulley 670 can be positioned below right movable carriage assembly 500. Right secondary counter weight cable 685 can have a fixably attached adjustable cable loop 683 and can be centered with cable spacers 686 and fixably attached between right outwardly facing carriage plate lower counter weight cable tab 570 and right inwardly facing carriage plate lower counter weight cable tab 575. Pulley 675 can be rotationally attached behind pulley 670 and under right counter weight 655. Right secondary counter weight cable 685 can descend vertically to front edge of pulley 670, horizontally from bottom edge of pulley 670 to bottom edge of pulley 675 then ascend vertically from back edge of pulley 675 to counter weight 655 where it can be fixably attached through adjustable cable loop 684 to right lower counter weight bracket 695. Right carriage counter weight system 650 can allow for near weightless vertical adjustments of right moveable carriage assembly 500, right converging press arm 145 and right arm rotating pulley system 300. Height adjustments of right movable arm carriage assembly 500, right converging press arm 145 and right arm rotating pulley system 300 can be achieved by pulling the spring-loaded pin 215 and moving carriage vertically on selector tube 65. Release spring loaded pin 215 at desired carriage height into selector tube hole(s) 61.

Important: Counter weight assembly 650 can be utilized in both weight stack designed fitness machines as well as weight plate loaded strength training fitness machines.

FIG. 14-16 of fitness machine of FIG. 1 as right movable carriage assembly 500 is vertically adjusted the right counter weight assembly 650 moves an equal distance in the opposite direction neutralizing the weight of the right movable carriage 500, right converging press arm 145 and right arm rotating pulley assembly 300.

Note: The weight stack 705 utilized in the master trainer design is typical of weight stack systems currently used throughout the fitness equipment industry and consists of individual weight plates, a pin to select the desired weight/resistance and a selector shaft attached to the top weight stack plate as part of the system to secure the desired weight to the top plate and weight stack pulley there by providing weight/resistance to the weight stack cable. For our design the weight stack is sourced from an industry provider.

Figure 17:
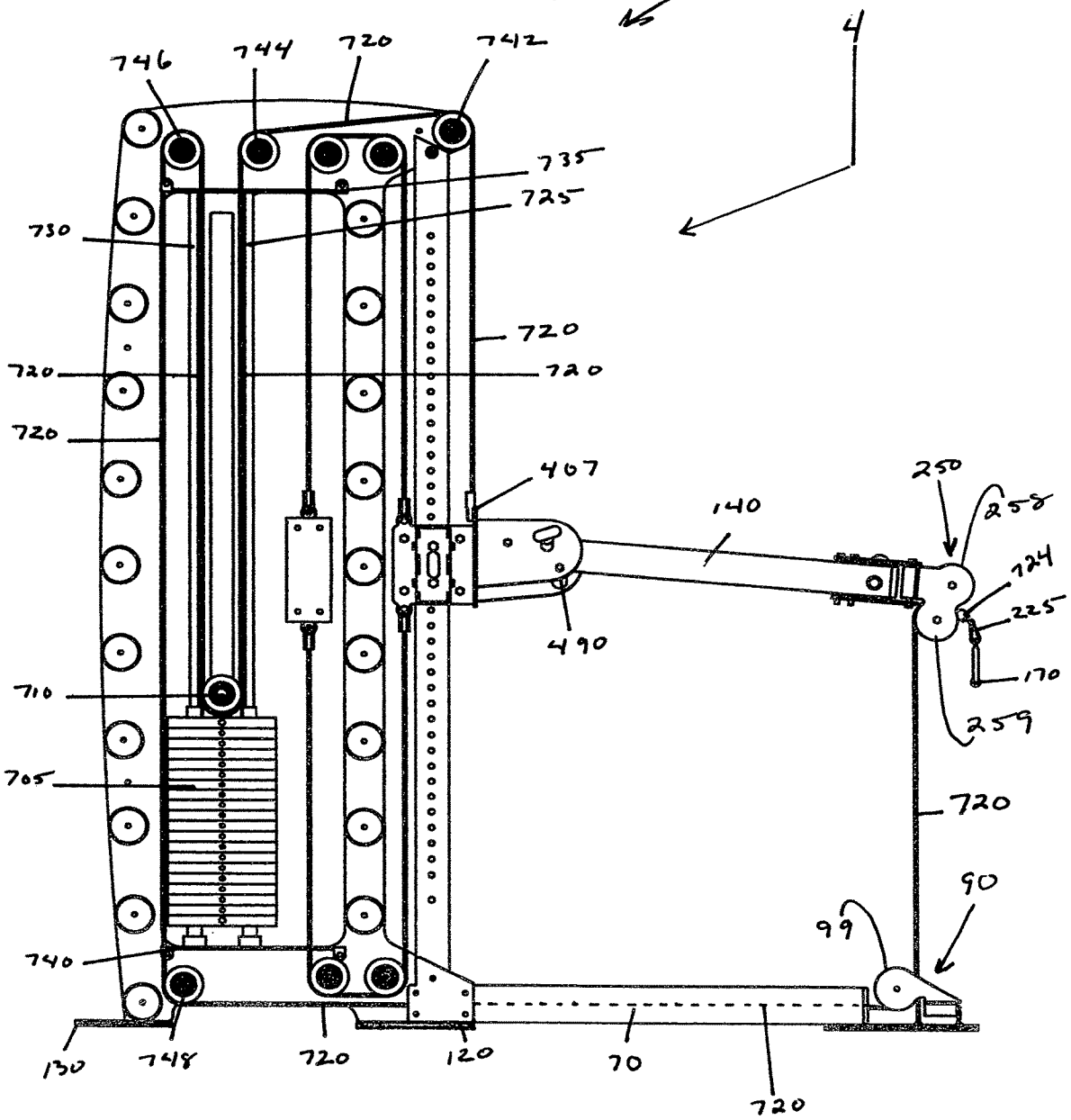

FIG. 17 of fitness machine 1 of FIG. 1 refers to left weight stack assembly 700. Left weight stack assembly 700 is an enlarged left view of main frame 4 with outwardly facing frame 5 removed to reveal the left weight stack assembly 700. Located between left outwardly facing frame 5 and left inwardly facing frame 15 and situated behind left counter weight 605 within main frame 4 can be a weight stack 705. Weight stack 705 is typical of weight stack/resistance systems employed in fitness machines. Weight stack 705 can rest on top of bottom guide plate 740. Bottom guide plate 740 can be fixably attached at the bottom of main frame 4 between left outwardly facing frame 5 and left inwardly facing frame 15. Additionally, top guide plate 735 can be fixably attached at the top of main frame 4 between left outwardly facing frame 5 and left inwardly facing frame 15. Top guide plate 735 and bottom guide plate 740 can contain a set of fixably attached parallel placed vertical guide rods 725 and 730. Weight stack 705 can be held in place by guide rod 725 and guide rod 730. Weight stack 705 can freely ascend and descend vertically on guide rod 725 and guide rod 730. Weight stack pulley 710 can be rotationally attached inside weight stack pulley bracket 715. Weight stack bracket 715 can be fixably attached to the top of weight stack 705. Situated between left outwardly facing frame 5 and left inwardly facing frame 15 can be a rotationally attached pulley 742. Pulley 742 can be positioned above left front carriage plate tab 407. Positioned slightly lower and behind pulley 742 and above front of weight stack pulley 710 can be rotationally attached pulley 744. Positioned directly behind pulley 744 can be a rotationally attached pulley 746. Pulley 746 can be positioned above the rear of weight stack pulley 710. Additionally, a rotationally attached pulley 748 can be located directly under pulley 746 within the base of main frame 4.

Located on a beginning end of weight stack cable 720 can be fixably attached adjustable loop 721 that can be fixably attached to left front carriage plate tab 407. Weight stack cable 720 can ascend vertically to the front edge of pulley 742, descending slightly from the top edge of pulley 742 to the top edge of pulley 744, descending vertically from the back edge of pulley 744 to front edge of weight stack pulley 710, ascending vertically from the back edge of weight stack pulley 710 to the front edge of pulley 746, descending vertically from the back edge of pulley 746 to the back edge of pulley 748 then traveling horizontally from the bottom edge of pulley 748 to the front of left leg 70 entering left foot rotating pulley assemble 90 at the bottom edge of left foot pulley 99 then ascending vertically from the front edge of left foot pulley 99 into left arm rotating pulley assembly 250 exiting between left arm top pulley 259 and left arm bottom pulley 260.

Located on a terminal end of weight stack cable 720 and extending from the front left arm rotating pulley assembly 250 between left top arm pulley 259 and left bottom arm pulley 260 can be a fixably attached cable end loop 722 with a fixably attached carabiner clip 225. Carabiner clip 225 can have a handle 170. Weight stack cable 720 can be positioned in place by a fixably attached cable stopper 724 situated before and held in place by cable loop end 722.

The cable system employed in Assembly 700 is a closed loop block and tackle design with fixed ends at left rotating arm pulley assembly 250 by way of cable stopper 724 and left front carriage plate tab 407 allowing for vertical adjustments of the movable arm carriage 400 without effecting the vertical location of weight stack 705.

Figure 18:
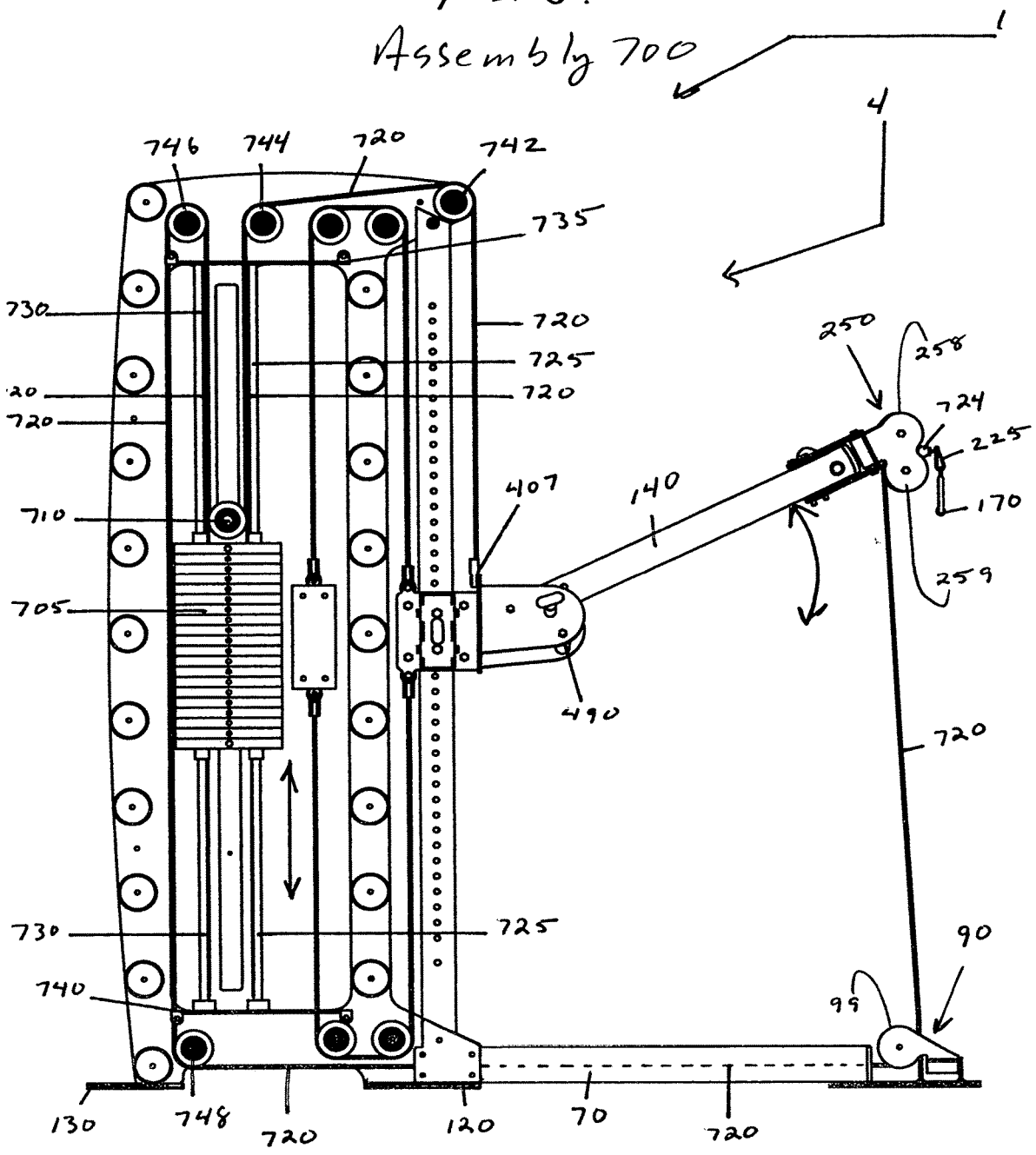

FIG. 18 of fitness machine of FIG. 1 is an enlarged left view of main frame 4 with left press arm 140 and left arm rotating pulley assembly 250 at a middle position with left counter weight 605 at a middle position and left converging press arm 140 pivoting upward and weight stack 705 moving upward. The left moveable carriage assembly 400 of main frame 4 can include an upwardly pivoting left converging press arm 140. Located at the end of left converging press arm 140 can be a fixably attached left arm rotating pulley assembly 250. Left arm rotating pulley assembly 250 can include weight stack cable 720 positioned between left arm top pulley 259 and left arm bottom pulley 260. Weight stack cable 720 can be kept in place between left arm top pulley 259 and left arm bottom pulley 260 by cable stopper 724. The weight stack cable 720 can follow a serpentine path around weight stack pulleys 710, 742, 744, 745, 748 being fixably attached to left front carriage plate tab 407 (see FIG. 17 assembly 700 for detailed description of weight stack assembly and location of individual parts). As upwardly pivoting left converging press arm 140 and fixably attached left arm rotating pulley assembly 250 are lifted upward the weight stack cable 720 contained within main frame 4 shortens there by vertically moving weight stack 705 upward on guide rod 725 and guide rod 730 applying resistance to left arm handle 150 of left converging press arm 140. Cable stopper 724 can keep the weight stack cable 720 from traveling backwards through left arm pulley assembly 250 when left converging arm 140 is raised and/or lowered. As left converging press arm 140 is raised and/or lowered left arm pulley assembly rotating 250 and left foot rotating pulley assembly 90 can rotate in unison as press arm 140 converges Inward thus keeping the weight stack cable 720 aligned with left arm top pulley 259, left bottom arm pulley 260, left foot pulley 99 and pulley 748.

Movable carriage assembly 400, left converging press arm 140 and left rotating arm pulley assembly 250 can be adjusted for height on left selector tube 60 with spring loaded pop pine 215 securing movable carriage assembly 400 into the desired left selector hole(s) 61. This feature allows converging press arm 140 to be pressed and/or pulled upward from all carriage adjustment positions. The middle position of FIG. 18 is for illustration purposes only and is not intended to limit the use, adjustability and/or function of fitness machine of FIG. 1.

Figure 19:
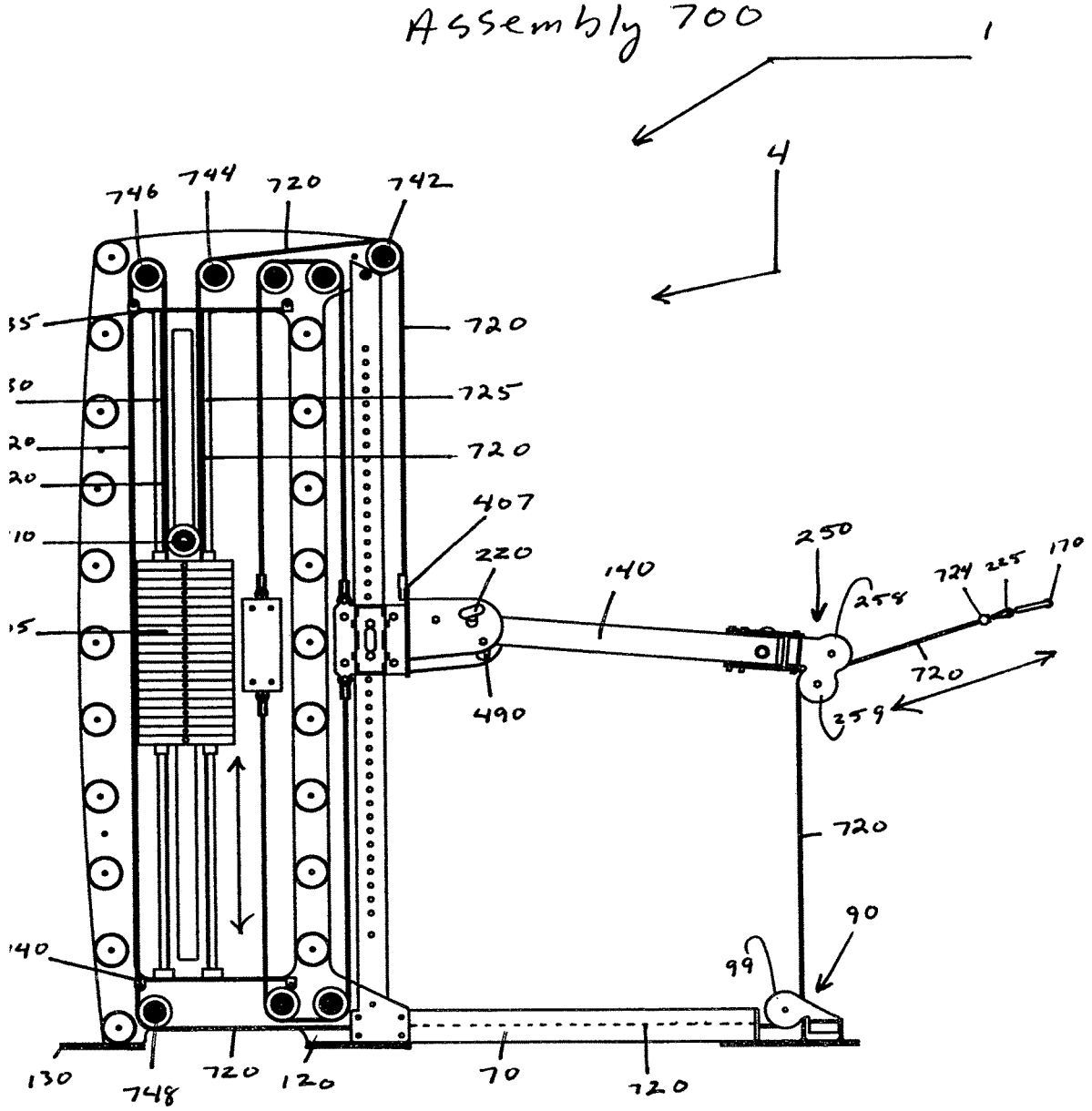

FIG. 19 of fitness machine of FIG. 1 is an enlarged left view of main frame 4 with left press arm 140 and left arm rotating pulley assembly 250 at a middle position with left counter weight 605 at a middle position and left converging press arm 140 locked into position with spring loaded locking pin 220 and cable handle 170 being pulled outward and upward and weight stack 705 moving upward. Left converging press arm 140 and left rotating arm pulley assembly 250 can be secured in a fixed position with locking spring loaded pin 220. A cable handle 170 can be fixably attached to carabiner 225. Carabiner 225 can be fixably attached to fixed cable loop 722 located at the outward end of weight stack cable 720. Left cable handle 170 can be pushed, pulled and/or pressed away from left rotating pulley assembly 250 shortening the weight stack cable 720 within main frame 4 vertically moving weight stack 705 upward on guide rod 725 and guide rod 730 applying resistance to handle 170. Spring loaded locking pin 220 secures left converging press arm 140 and left rotating arm pulley 250 into a fixed position eliminating arm movement when left cable handle 170 is pushed, pulled and/or pressed upward. As left cable handle 170 is pushed, pulled and/or pressed across multiple planes left arm rotating pulley assembly 250 and left foot rotating pulley assembly 90 can rotate in unison thus keeping weight stack cable 720 aligned with left top arm pulley 259, left bottom arm pulley 260, left foot pulley 99 and pulley 748.

Due to the design of left foot rotating pulley assembly 90 and left arm rotating pulley assembly 250 each pulley system can move along opposing planes while maintaining left weight stack cable 720 alignment within each rotating pulley assembly. These assemblies will be described later.

Movable carriage assembly 400, left converging press arm 140 and left rotating arm pulley assembly 250 can be adjusted for height on left selector tube 60 with spring loaded pin 215 securing movable carriage assembly 400 to the desired left selector tube hole(s) 61. This feature allows left arm rotating pulley assembly 250 to be pushed, pulled and/or pressed from all carriage adjustment positions. The middle position of FIG. 19 is for illustration purposes only and is not intended to limit the use, adjustability and/or function of fitness machine of FIG. 1.

Figure 20:
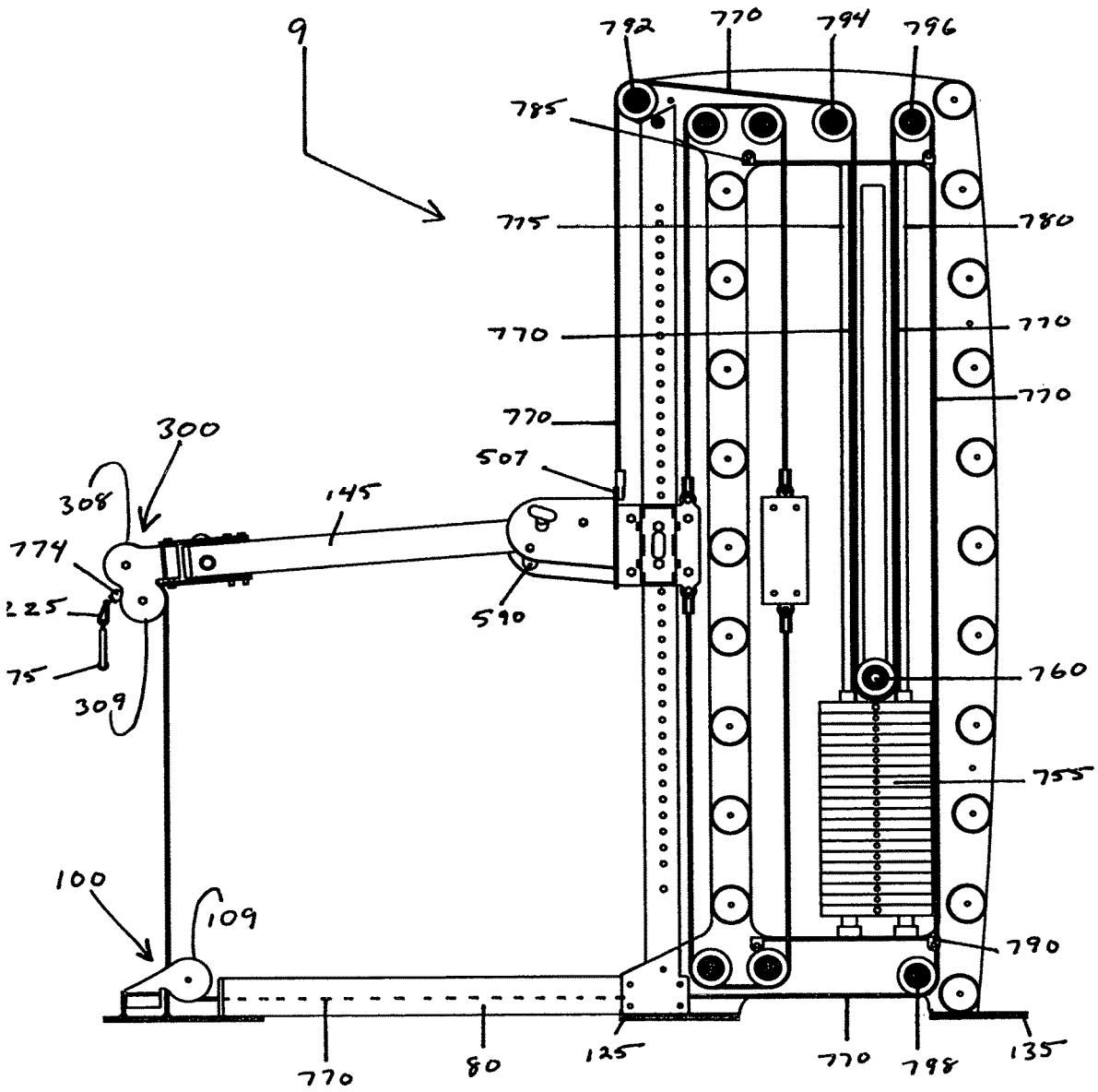

FIG. 20 of fitness machine of FIG. 1 refers to the right weight stack assembly 750. Right weight stack assembly 750 is an enlarged right view of Main frame 9 with outwardly facing fame 10 removed to reveal the right weight stack assembly 750. Located between right outwardly facing frame 10 and right inwardly facing frame 20 situated behind right counter weight 655 within main frame 9 can be a weight stack 755. Weight stack 755 is typical of weight stack/resistance systems employed in fitness machines. Weight stack 755 can rest on top of bottom guide plate 790. Bottom guide plate 790 can be fixably attached at the bottom of main frame 9 between right outwardly facing frame 10 and right inwardly facing frame 20. Additionally, top guide plate 785 can be fixably attached at the top of main frame 9 between right outwardly facing frame 10 and right inwardly facing frame 20. Top guide plate 785 and bottom guide plate 790 can contain a set of fixably attached parallel placed vertical guide rods 775 and 780. Weight stack 755 can be held in place by guide rod 775 and guide rod 780. Weight stack 755 and can freely ascend and descend vertically on guide rod 775 and guide rod 780. Weight stack pulley 760 can be rotationally attached inside weight stack pulley bracket 765. Weight stack pulley bracket 765 can be fixably attached to top of weight stack 755. Situated between right outwardly facing frame 10 and right inwardly facing frame 20 can be a rotationally attached pulley 792. Pulley 792 can be positioned above right front carriage plate tab 507. Positioned slightly lower and behind pulley 792 and above front of weight stack pulley 760 can be rotationally attached pulley 794. Positioned directly behind pulley 794 can be rotationally attached pulley 796. Pulley 796 can be positioned above rear of weight stack pulley 760. Additionally, a rotationally attached pulley 798 can be located directly under pulley 796 within the base of main frame 9.

Located on a beginning end of weight stack cable 770 can be fixably attached adjustable cable loop 771 fixably attached to right front carriage plate tab 507. Weight stack cable 770 can ascend vertically to the front edge of pulley 792, descending slightly from the top edge of pulley 792 to the top edge of pulley 794, descending vertically from the back edge of pulley 794 to the front edge of weight stack pulley 760, ascending vertically from back edge of weight stack pulley 760 to the front edge of pulley 796, descending vertically from back edge of pulley 796 to the back edge of pulley 798 traveling horizontally from the bottom edge of pulley 798 to the front of right leg 80 entering right foot rotating pulley assembly 100 at the bottom edge of right foot pulley 109 then ascending vertically from the front edge of right foot pulley 109 into right arm rotating pulley assembly 300 exiting between right arm top pulley 309 and right arm bottom pulley 310.

Located on a terminal end of weight stack cable 770 and extending from the front right arm rotating pulley assembly 300 between right top arm pulley 309 and right bottom arm pulley 310 can be a fixably attached cable end loop 772 with a fixably attached carabiner clip 225. Carabiner clip 225 can have a fixably attached handle 175. Weight stack cable 770 can be positioned by a fixably attached cable stopper 774 situated before and held in place by cable loop end 772.

The cable system employed in assembly 750 is a closed loop block and tackle design with fixed ends at right arm rotating arm pulley assembly 300 by way of cable stopper 774 and right front carriage plate tab 507 allowing for vertical adjustments of the movable arm carriage assembly 500 without effecting the vertical location of weight stack 755.

Figure 21:
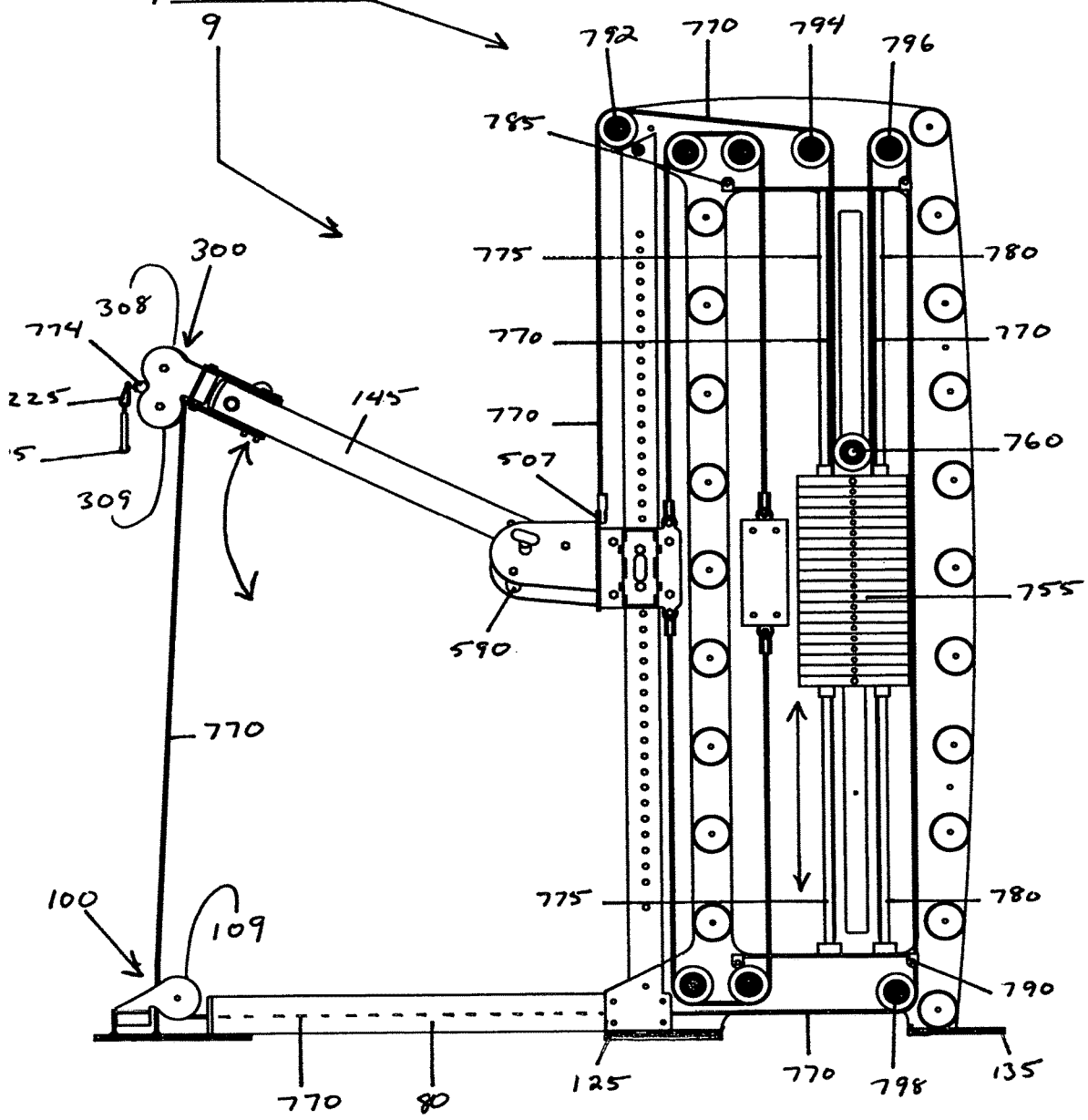

FIG. 21 of fitness machine of FIG. 1 is an enlarged right view of main frame 9 with right outwardly facing frame 10 removed and right movable carriage assembly 500, right converging press arm 145 and right arm rotating pulley system 300 at a middle position with right counter weight 655 at a middle position and right converging press arm 145 pivoting upward and weight stack 755 moving upward.

The right movable carriage assembly 500 of main frame 9 can include an upwardly pivoting right converging press arm 145. Located at the end of right converging press arm 145 can be a fixably attached right arm rotating pulley assembly 300. Right arm rotating pulley assembly 300 can include weight stack cable 770 positioned between right arm top pulley 309 and right arm bottom pulley 310. Weight stack cable 770 can be kept in place can between right arm top pulley 309 and right arm bottom pulley 310 by cable stopper 774. The weight stack cable 770 can follow a serpentine path around weight stack pulleys 760. 792, 794, 796 and 798 being fixably attached to right front carriage plate tab 507 (see FIG. 18 assembly 750 for detailed description of weight stack assembly and location of individual parts). As upwardly pivoting right converging press arm 145 and fixably attached right arm rotating pulley assembly 300 are lifted upward the weight stack cable 770 within main frame 9 shortens there by vertically moving weight stack 755 upward on guide rod 775 and guide rod 780 applying resistance to right arm handle 155 and right converging press arm 145. As right converging press arm 145 is raised and/or lowered right rotating arm pulley assembly 300 and right foot rotating pulley assembly 100 can rotate in unison thus keeping the weight stack cable 770 aligned with right top arm pulley 309, right bottom arm pulley 310, right foot pulley 109 and pulley 798.

Movable carriage assembly 500, right converging press arm 145 and right rotating arm pulley assembly 300 can be adjusted for height on right selector tube 65 with spring loaded pin 215 securing movable carriage assembly 500 into the desired right selector hole(s) 66. This feature allows converging press arm 145 to be pressed and/or pulled upward from all carriage adjustment positions. The middle position of FIG. 21 is for illustration purposes only and is not intended to limit the use, adjustability and/or function of fitness machine of FIG. 1.

Figure 22:
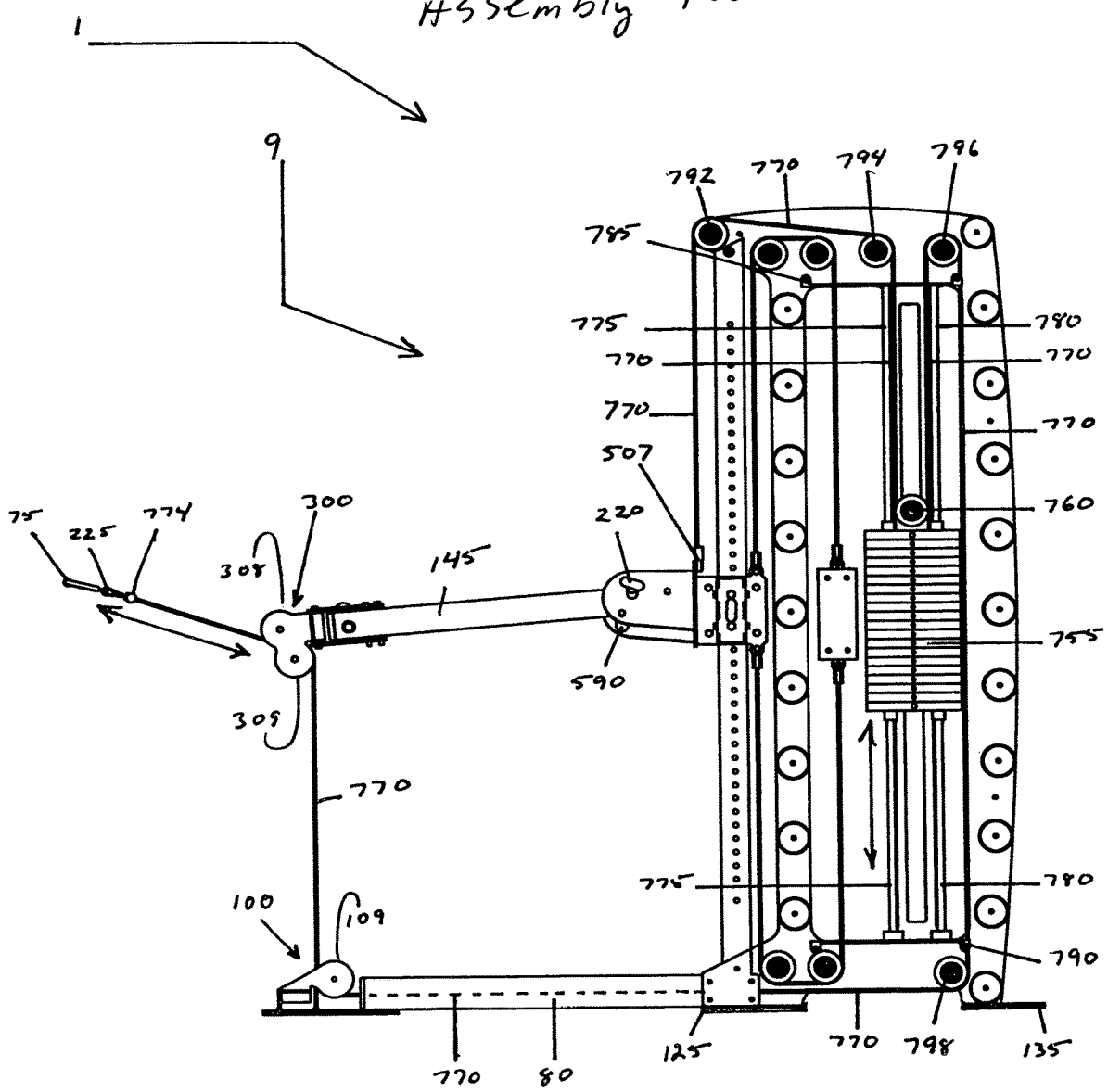

FIG. 22 of fitness machine of FIG. 1 is an enlarged right view of main frame 9 with right outwardly facing frame 10 removed and right movable carriage assembly 500, right converging press arm 145 and right arm rotating pulley assembly 300 at a middle position with right counter weight 655 at a middle position and right converging press arm 145 locked into position with spring loaded locking pin 220 and cable handle 175 being pulled outward and upward and weight stack 755 moving upward. Right converging press arm 145 and right rotating arm pulley assembly 300 can be secured in a fixed position with spring loaded locking pin 220. Right cable handle 175 can be fixably attached to carabiner 225. Carabiner 225 can be fixably attached to fixed cable loop 772 located at the outward end of weight stack cable 770. Right cable handle 175 can be pushed, pulled and/or pressed away from right rotating pulley assembly 300 shortening weight stack cable 770 within main frame 9 vertically moving weight stack 755 upward on guide rod 775 and guide rod 780 applying resistance to cable handle 175. Spring loaded locking pin 220 secures right converging press arm 145 and right rotating pulley assembly 300 into a fixed position eliminating arm movement when right cable handle 175 is pushed, pulled and/or pressed upward. As right cable handle 175 is pushed, pulled and/or pressed across multiple planes right arm rotating pulley assembly 300 and right foot rotating pulley assembly 100 can rotate in unison thus keeping weight stack cable 770 aligned with right top arm pulley 309, right bottom arm pulley 310, right foot pulley 109 and pulley 798.

Due to the design of right foot rotating pulley assembly 100 and right arm rotating pulley assembly 300 each pulley system can move along opposing planes while maintaining right weight stack cable 770 alignment within each pulley assembly. These assemblies will be described later.

Movable carriage assembly 500, right converging press arm 145 and right rotating arm pulley assembly 300 can be adjusted for height on right selector tube 65 with spring loaded pin 215 securing movable carriage assembly 500 to the desired right selector hole(s) 66. This feature allows right arm rotating pulley assembly 300 to be pushed, pulled and/or pressed from all carriage adjustment positions. The middle position of FIG. 22 is for illustration purposes only and is not intended to limit the use, adjustability and/or function of fitness machine of FIG. 1.

Figure 23:
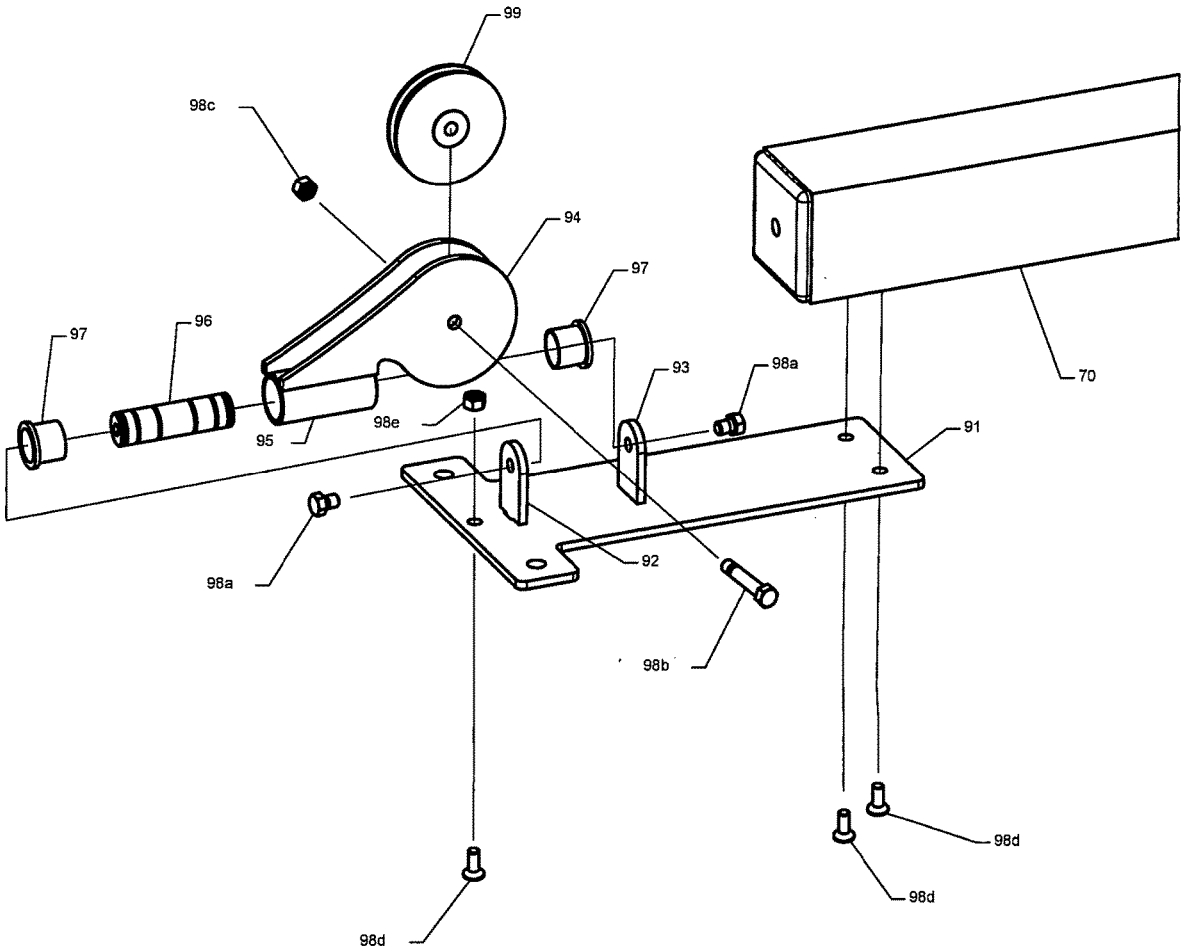
FIG. 23 is an enlarged exploded view of left front foot pulley assembly (90)

FIG. 23 left foot rotating pulley assembly 90 of fitness machine of FIG. 1 can have a left foot pulley plate 91 fixably attached to the front edge of left leg 70. Left foot rotating pulley assembly 90 can additionally have left foot front pulley bracket 92 and left foot rear pulley bracket 93 fixably attached to an upper side of left foot pulley plate 91. Left foot pulley holder 94 can contain a rotationally attached left foot pulley 99. Left foot pulley holder 94 can additionally have a fixably attached left foot bearing/bushing hub 95. Left foot bearing/bushing hub 95 can have left foot bearing/bushing 97 pressed into opposing ends of left foot bearing/bushing hub 95. Left foot bearing/bushing hub 95 can have a left foot pulley shaft 96 inserted through left foot bearing/bushing 97 and can be fixably attached between left foot front pulley bracket 92 and left foot rear pulley bracket 93. Left front foot pulley assembly 90 can rotate freely on the center axis of left pulley shaft 96 which can be aligned with the center point of left weight stack cable 720. Left weight stack cable 720 can aligned with the bottom edge of left foot pulley 99. This feature allows left foot pulley holder 94 and left foot pulley 99 to freely rotate without effecting the location of left weight stack cable 720 keeping left foot pulley 99 and left weight stack cable 720 in alignment.

Figure 24:
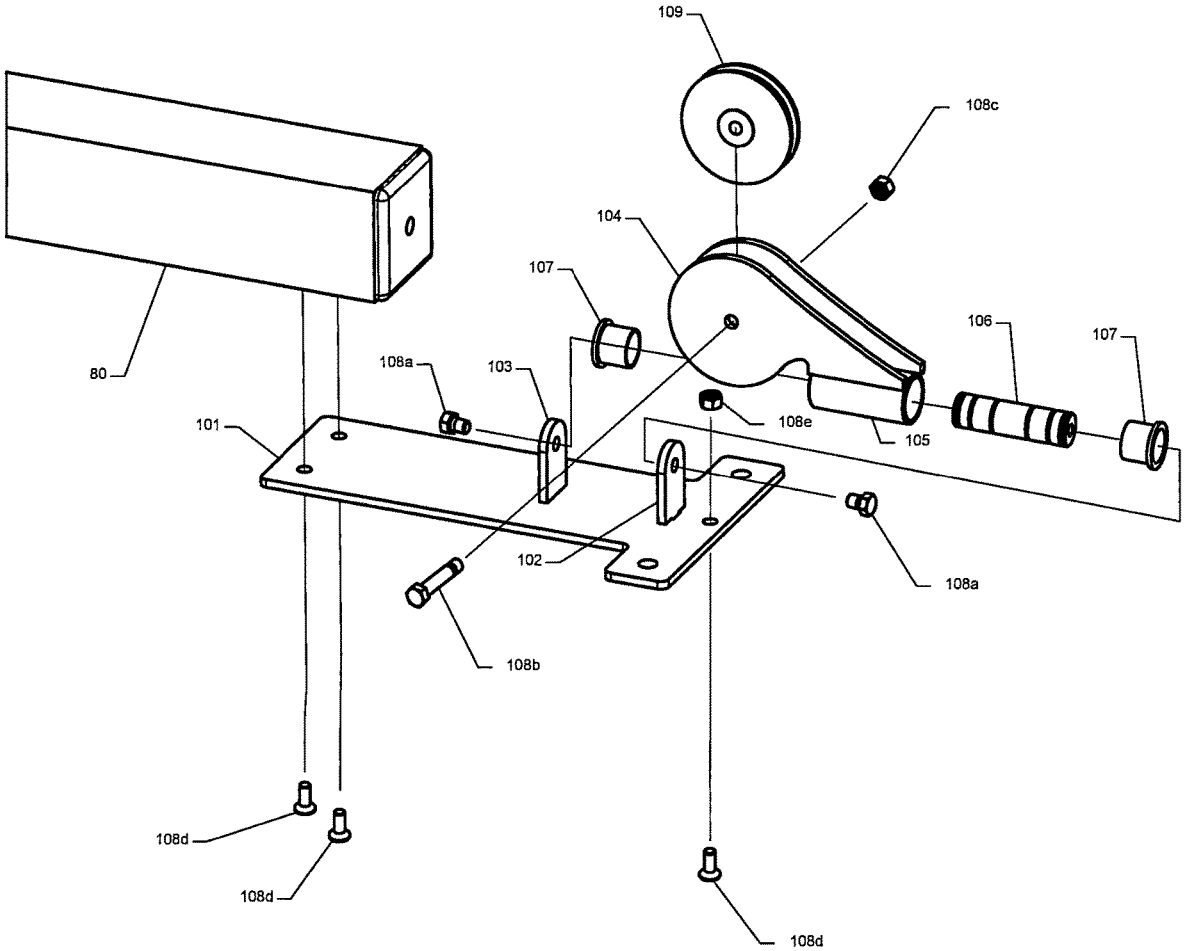
FIG. 24 is an enlarged exploded view of right front foot pulley assembly (100)

FIG. 24 right foot rotating pulley assembly 100 of fitness machine of FIG. 1 can have a right foot pulley plate 101 fixably attached to the front edge of right leg 80. Right foot rotating pulley assembly 100 can additionally have right foot front pulley bracket 102 and right foot rear pulley bracket 103 fixably attached to an upper side of right front foot pulley plate 101. Right foot pulley holder 104 can contain a rotationally attached right foot pulley 109. Right foot pulley holder 104 can additionally have a fixably attached right foot bearing/bushing hub 105. Right foot bearing/bushing hub 105 can have right foot bearing/bushing 107 pressed into opposing ends of right foot bearing/bushing hub 105. Right foot bearing/bushing hub 105 can have a right foot bearing shaft 106 inserted through right foot bearing/bushing 107 and can be fixably attached between right foot front pulley bracket 102 and right foot rear pulley bracket 103. Right foot pulley assembly 100 can rotate on center axis of right pulley shaft 106 and can be aligned with the center point of right weight stack cable 770. Right weight stack cable 770 can be aligned with the bottom edge of right foot pulley 109. This feature allows right foot pulley holder 104 and right foot pulley 109 to freely rotate without effecting the location of right weight stack cable 770 keeping right foot pulley 109 and right weight stack cable 770 in alignment.

Figure 25:
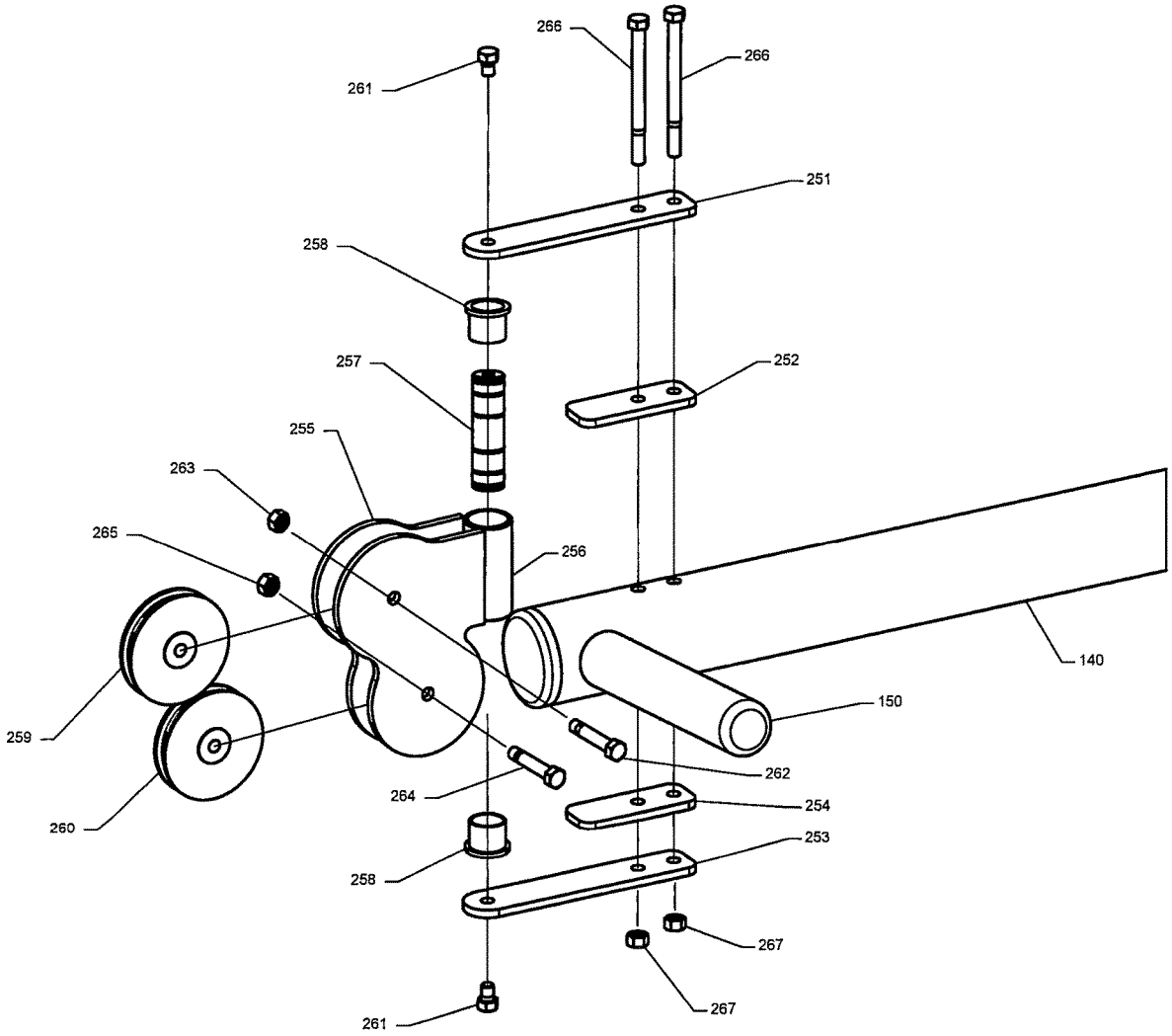
FIG. 25 is an enlarged exploded view of the left arm pulley assembly (250)

FIG. 25 left arm rotating pulley assembly 250 of fitness machine of FIG. 1 can have a top left pulley bracket 251 and a bottom left pulley bracket 253 fixably attached to the outwardly facing end of left converging press arm 140. Top left pulley bracket spacer 252 can be positioned between top left pulley bracket 251 and left converging press arm 140. Likewise, bottom left pulley bracket spacer 254 can be positioned between bottom left pulley bracket 253 and left converging press arm 140. Left arm rotating pulley assembly 250 can additionally have a left arm pulley holder 255 which can contain a rotationally attached left arm top pulley 259 and rotationally attached left arm bottom pulley 260. Left arm pulley holder 255 can be fixably attached to left arm bearing/bushing hub 256. Left arm bearing/bushing hub can have left arm pulley bearing/bushing 258 pressed into opposing ends of left bearing/bushing hub 256. Left arm bearing/bushing hub 256 can have left arm pulley shaft 257 inserted through the left arm pulley bearing/bushing 258 and be fixably attached between outwardly facing ends of top left pulley bracket 251 and bottom left pulley bracket 253. Left arm rotating pulley assembly 250 can rotate on the center axis of left arm pulley shaft 257. The center axis of left arm pulley shaft 257 can be aligned with the center point of left weight stack cable. 720. Left weight stack cable 720 can be aligned with the back edge of left arm bottom pulley 260. This feature allows left arm pulley holder 255 and left arm bottom pulley to freely rotate without effecting the location of left weight stack cable 720 keeping left arm bottom pulley 260 and left weight stack cable 720. in alignment.

Figure 26:
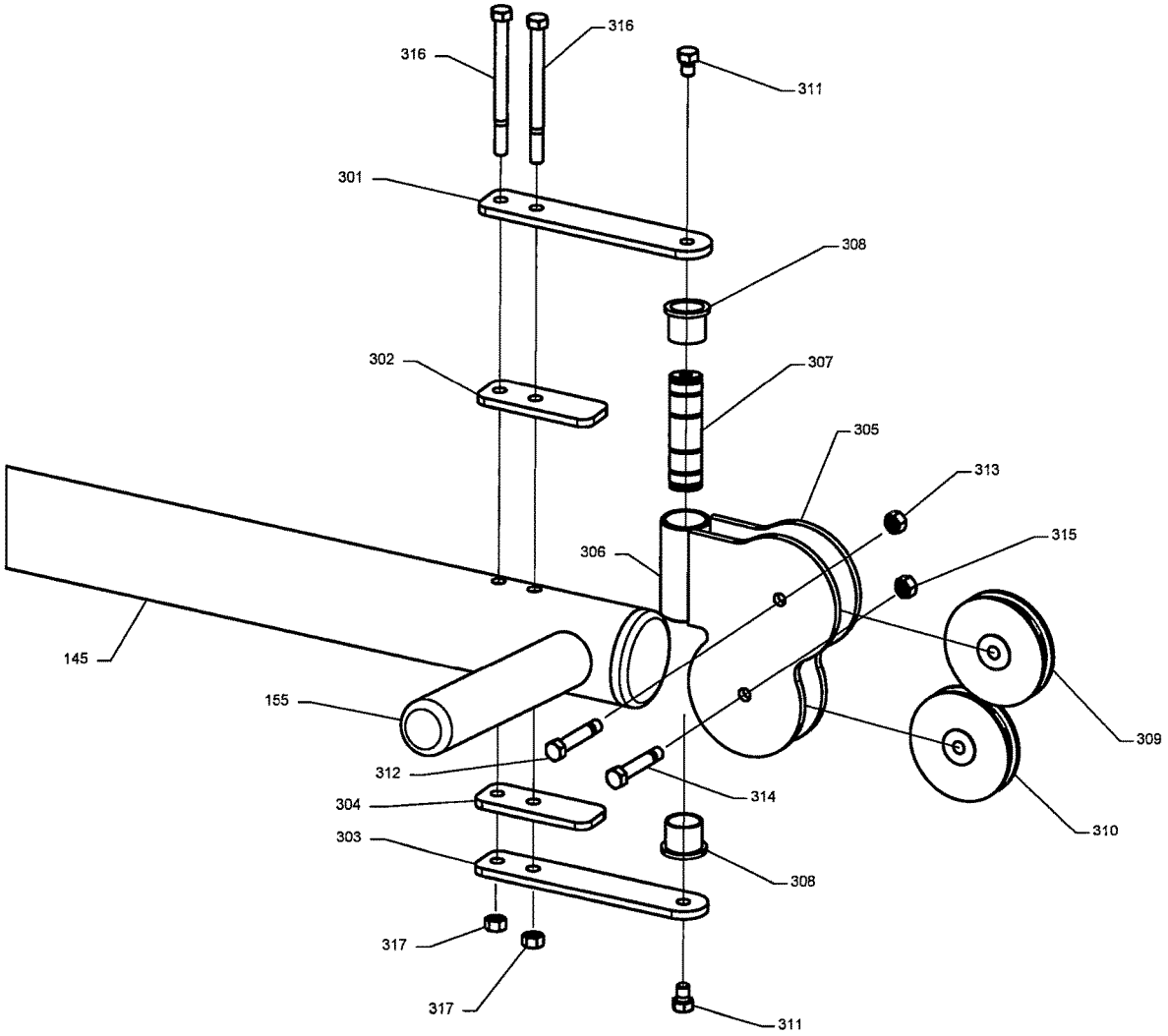
FIG. 26 is an enlarged exploded view of the right arm pulley assembly (300)

FIG. 26 right arm rotating pulley assembly 300 of fitness machine of FIG. 1 can have a top right pulley bracket 301 and a bottom right pulley bracket 303 fixably attached to the outwardly facing end of right converging press arm 145. Top right pulley bracket spacer 302 can be positioned between top right pulley bracket 301 and right converging press arm 145. Likewise, bottom right pulley bracket spacer 304 can be positioned between bottom right pulley bracket 303 and right converging press arm 145. Right arm rotating pulley assembly 300 can additionally have a right arm pulley holder 305 which can contain a rotationally attached right arm top pulley 309 and rotationally attached right arm bottom pulley 310. Right arm pulley holder 305 can be fixably attached to right arm bearing/bushing hub 306. Right arm bearing/bushing hub 306 can have right arm bearing/ bushing 308 pressed into opposing ends of right bearing/bushing hub 306. Right arm pulley bearing/bushing hub 306 can have right arm pulley shaft 307 inserted through right arm pulley bearing/bushing 308 and can be fixably attached between outwardly facing ends of top right pulley bracket 301 and bottom right pulley bracket 303. Right rotating pulley assembly 300 can rotate on the center axis of right arm pulley shaft 307. The center axis of right arm pulley shaft 307 can be aligned with the center point of right weight stack cable 770. Right weight stack cable 770 can be aligned with the back edge of right arm bottom arm pulley 310. This feature allows right arm pulley holder 305 and right bottom pulley 310 to freely rotate without effecting the location of right weight stack cable 770 keeping right arm bottom pulley 310 and right weight stack cable 770 in alignment.

Figure 27:
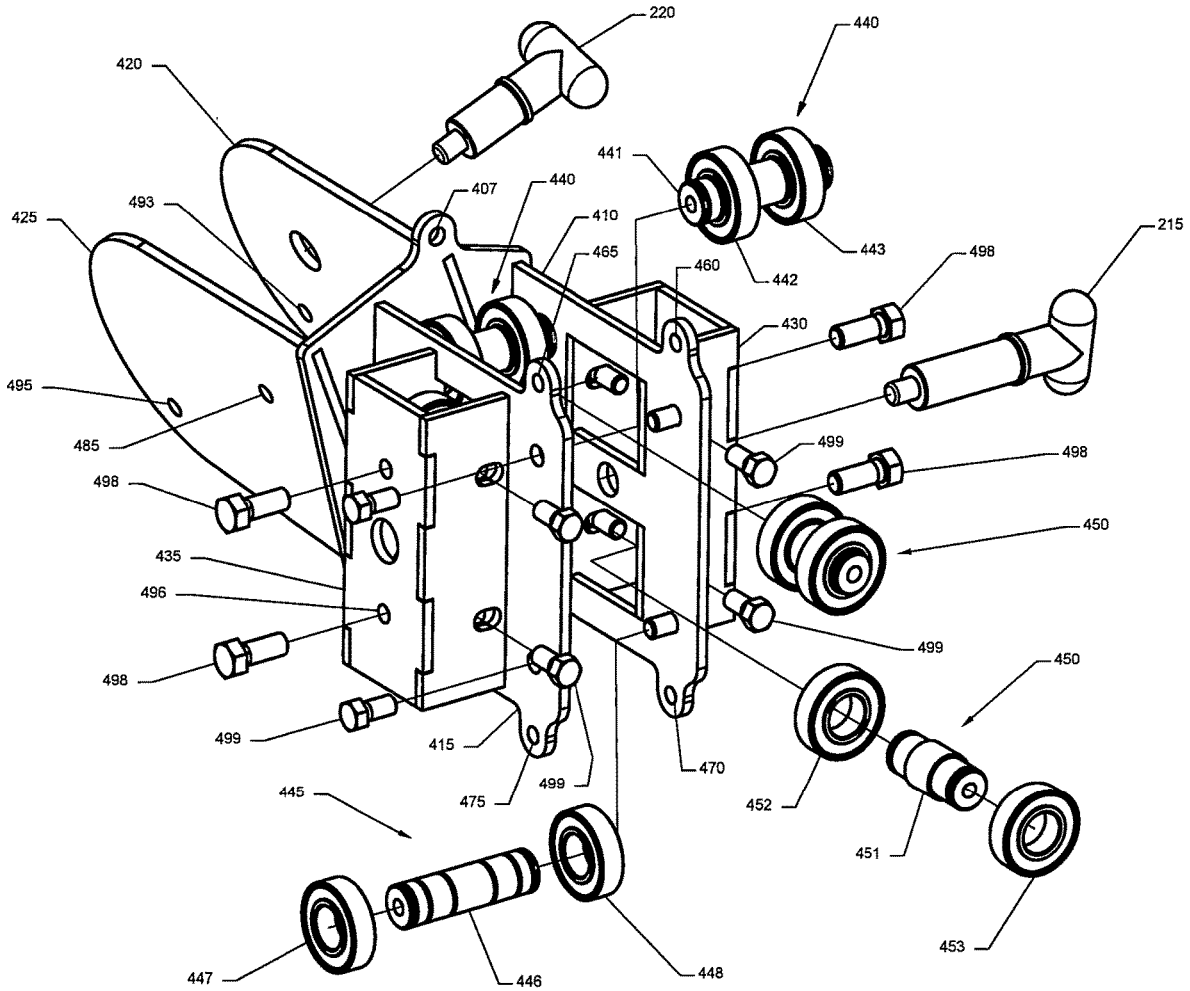
FIG. 27 is an enlarged exploded view of the left movable carriage assembly (400)
Figure 28:
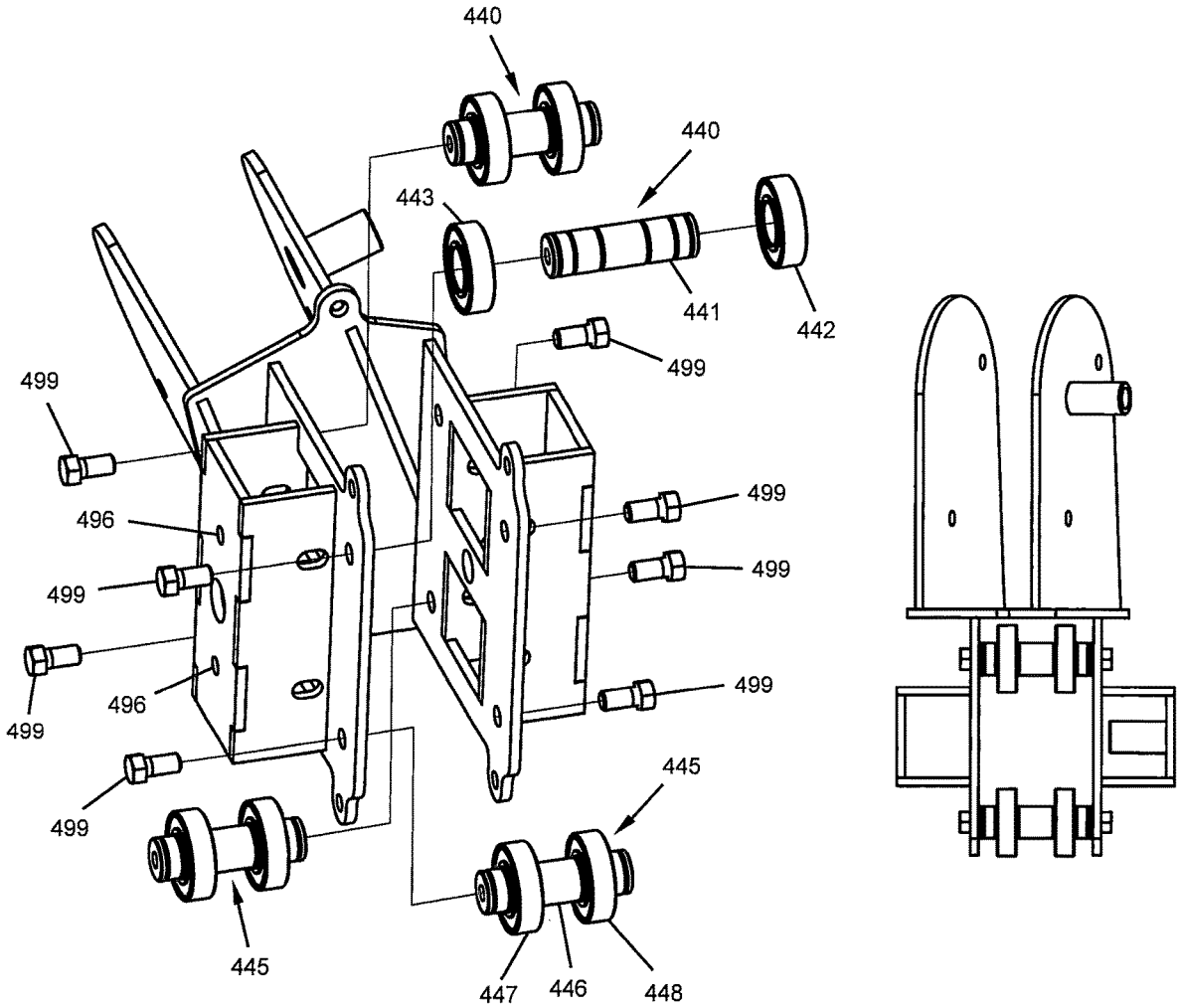
FIG. 28 is an enlarged exploded view of the left movable carriage assembly (400) upper main bearing wheel assembly (440) and lower main bearing wheel assembly (445)
Figure 29:
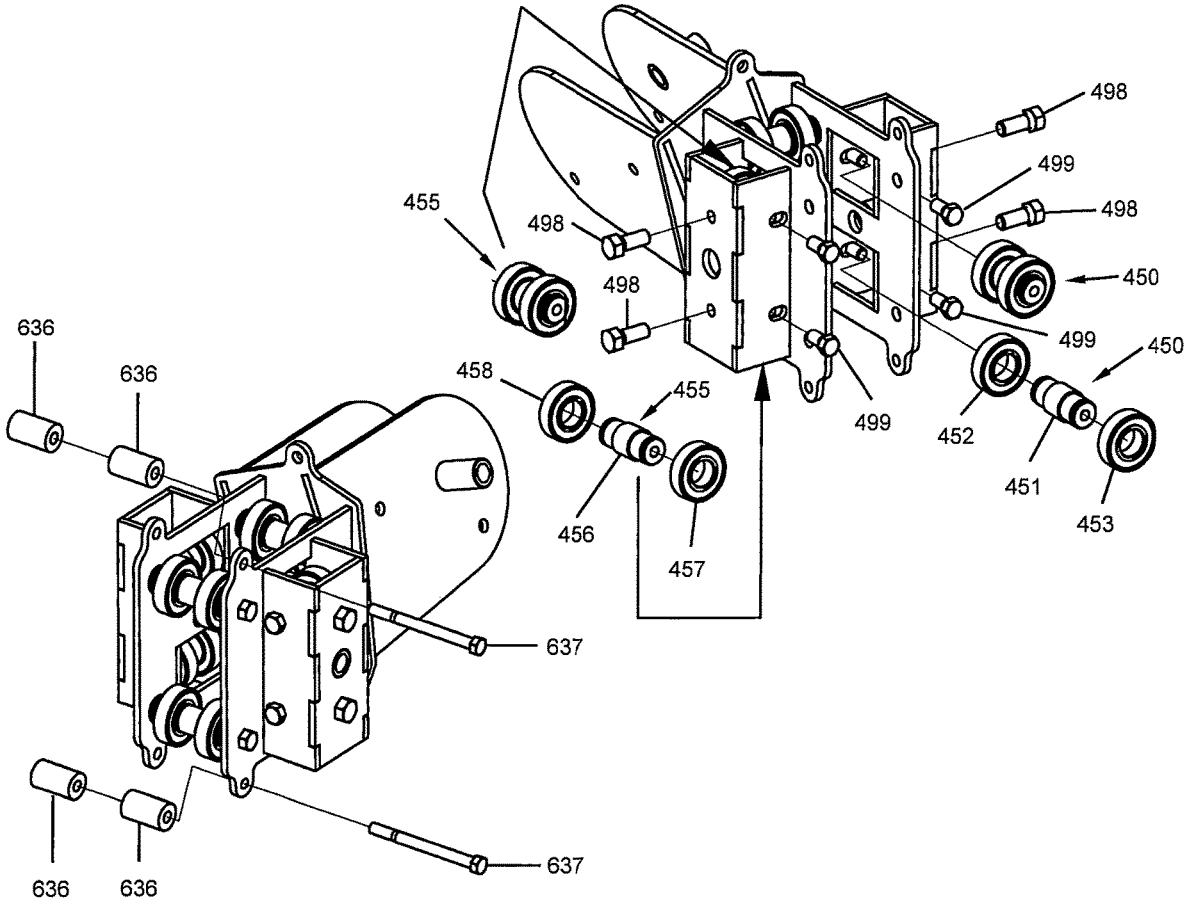
FIG. 29 is an enlarged exploded view of the left movable carriage assembly (400) left outwardly facing side bearing wheel assembly 450 and left inwardly facing side bearing wheel assembly (455)

FIG. 27-29 left movable carriage assembly 400 of fitness machine of FIG. 1 can include a left outwardly facing carriage plate 410 and a left inwardly facing carriage plate 415 separated by and fixed in a parallel manner to the back side of left front carriage plate 405. Upper main bearing wheel assembly 440 and lower main bearing wheel assembly 445 can be fixably attached to the inside walls of left outwardly facing carriage plate 410 and left inwardly facing carriage plate 415 allowing for left movable arm carriage assembly 400 to ride upwards and downwards on vertically positioned selector tube 60.

Each of the upper main bearing wheel assembly 440 can be located on a front and rear side of vertically positioned selector tube 60 to allow for left movable carriage assembly 400 to easily roll upwards and downwards on the vertically positioned selector tube 60. Each upper main bearing wheel assembly 440 can include a first wheel 442 and a second wheel 443 that are freely rotatable on shaft 441. Each of the lower main bearing wheel assembly 445 can be located on a front and rear side of vertically positioned selector tube 60 spaced under the top pair of left upper main bearing wheel assemblies 440. Each lower main bearing wheel assembly 445 can include a first wheel 447 and a second wheel 448 that are freely rotatable on shaft 446.

Left outwardly facing carriage plate 410 can include a left outwardly facing bearing box 430 fixed on the outside wall of carriage plate 410. Left outwardly facing bearing box 430 can have a fixably attached spring loaded pin 215. Additionally, each left outwardly facing side bearing wheel assembly 450 can be fixably attached in a vertical position inside outwardly facing bearing box 430. The left outwardly facing bearing wheel assemblies 450 can roll upwards and downwards on the left side of vertically positioned selector tube 60. Left outwardly facing bearing wheel assembly 450 can include a first wheel 452 and a second wheel 453 that are freely rotatable on shaft 451. Spring loaded pin 215 can be placed within a series of left selector hole(s) 61 allowing for height adjustments of left movable arm carriage assembly 400.

Left inwardly facing carriage plate 415 can include a left inwardly facing bearing box 435 fixed on the outside wall of left inwardly facing carriage plate 415. Additionally, each left inwardly facing side bearing wheel assembly 455 can be fixably attached in a vertical fashion inside left inwardly facing bearing box 435. The left inwardly facing bearing wheel assemblies 455 can roll upwards and downwards on the right side of vertically positioned selector tub 60. Left inwardly facing bearing wheel assembly 455 can include a first wheel 457 and a second wheel 458 that are freely rotatable on shaft 456.

Additionally, the front side of front carriage plate 405 can have a fixed parallelly placed equally angled left outwardly facing press arm plate 420 with a fixably attached spring loaded locking pin 220 and a left inwardly facing press arm plate 425. Spring loaded locking pin 220 can secure left converging press arm 140 and left rotating arm pulley assembly 250 into place while performing pushing, pulling and/or pressing exercises using left cable handle 170.

Left movable carriage assembly 400 can have a left converging press arm 140 pivotally mounted between left outwardly facing press arm plate 420 and left inwardly facing press arm plate 425. Left converging press arm 140 can move toward the centerline of fitness machine of FIG. 1 when lifted and upward and away from the centerline of when lowered. Additionally, located between left outwardly facing press arm plate 420 and left inwardly facing press arm plate 425 can be a fixably attached left arm stopper 490. Left arm stopper 490 can act as a resting point for left converging press arm 140. Left converging press arm 140 can have a fixably attached inwardly facing handle 150. The outward end of left converging press arm 140 can have a fixably attached left arm rotating pulley assembly 250.

Figure 30:
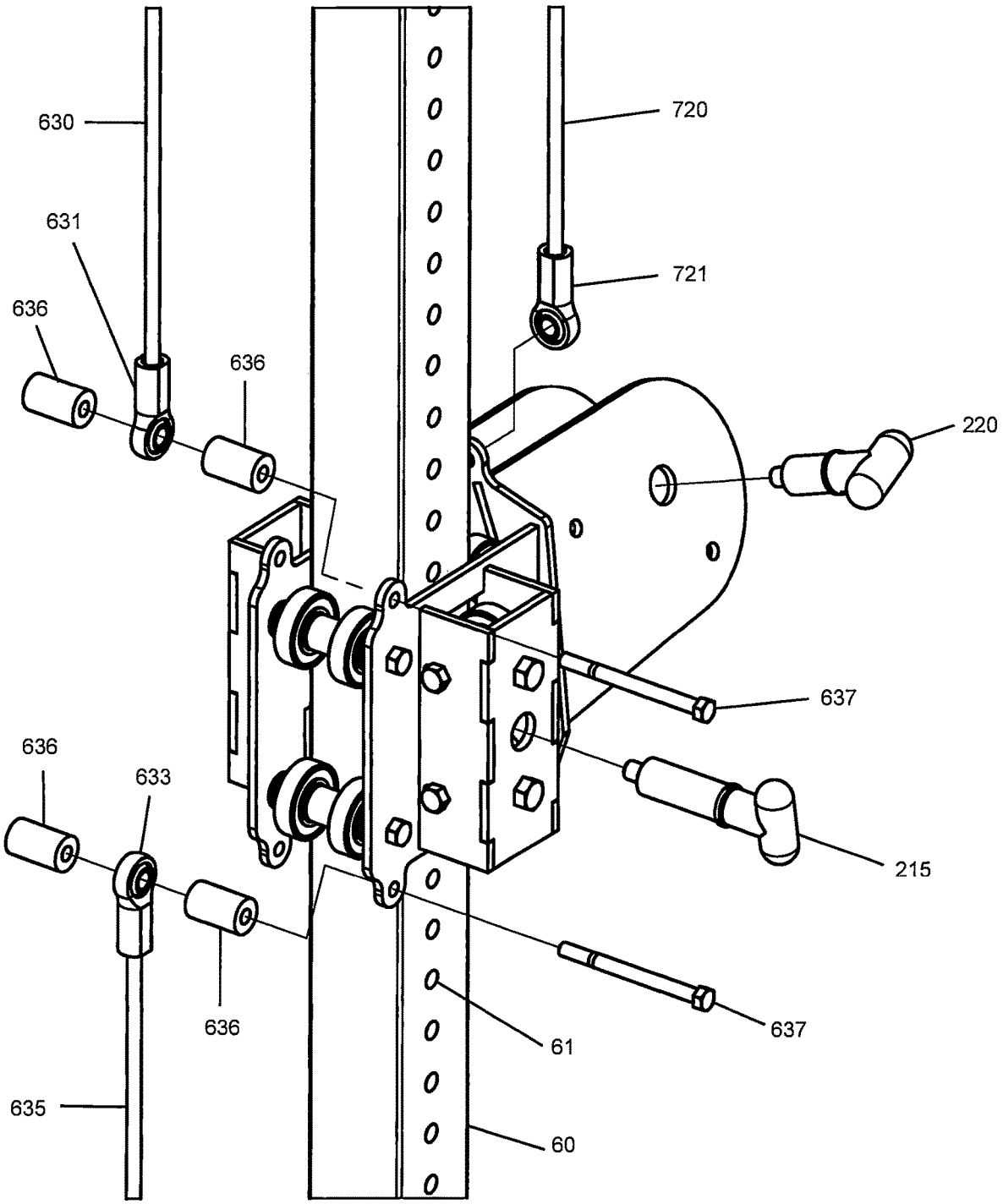
FIG. 30 is an enlarged view of the left movable carriage assembly (400) left weight stack cable (720) carriage attachment, left primary counter weight cable (630) carriage attachment and left secondary counter weight cable (635) carriage attachment

FIG. 30 left movable carriage assembly 400 of fitness machine of FIG. 1 can include a left primary counter weight cable 630 with fixably attached adjustable cable loop 631 centered between cable spacer(s) 636 and fixably attached to the upper rear of left movable carriage assembly 400 between left outwardly facing carriage plate upper tab 460 and left inwardly facing carriage plate upper tab 465. Similarly, left secondary counter weight cable 635 with fixably attached adjustable cable loop 633 can be centered between cable spacer(s) 636 and fixably attached to the left bottom rear of movable arm carriage 400 between left outwardly facing carriage plate lower counter weight tab 470 and left inwardly facing carriage plate lower counter weight tab 475. Left weight stack cable 720 can have a fixably attached weight stack cable adjustable loop 721 which can be fixably attached to left front carriage cable tab 407. Left movable carriage assembly 400 can be moved vertically on left selector tube 60 and can be secured into the desired left selector tube hole(s) 61 with fixably attached spring loaded pin 215.

Figure 31:
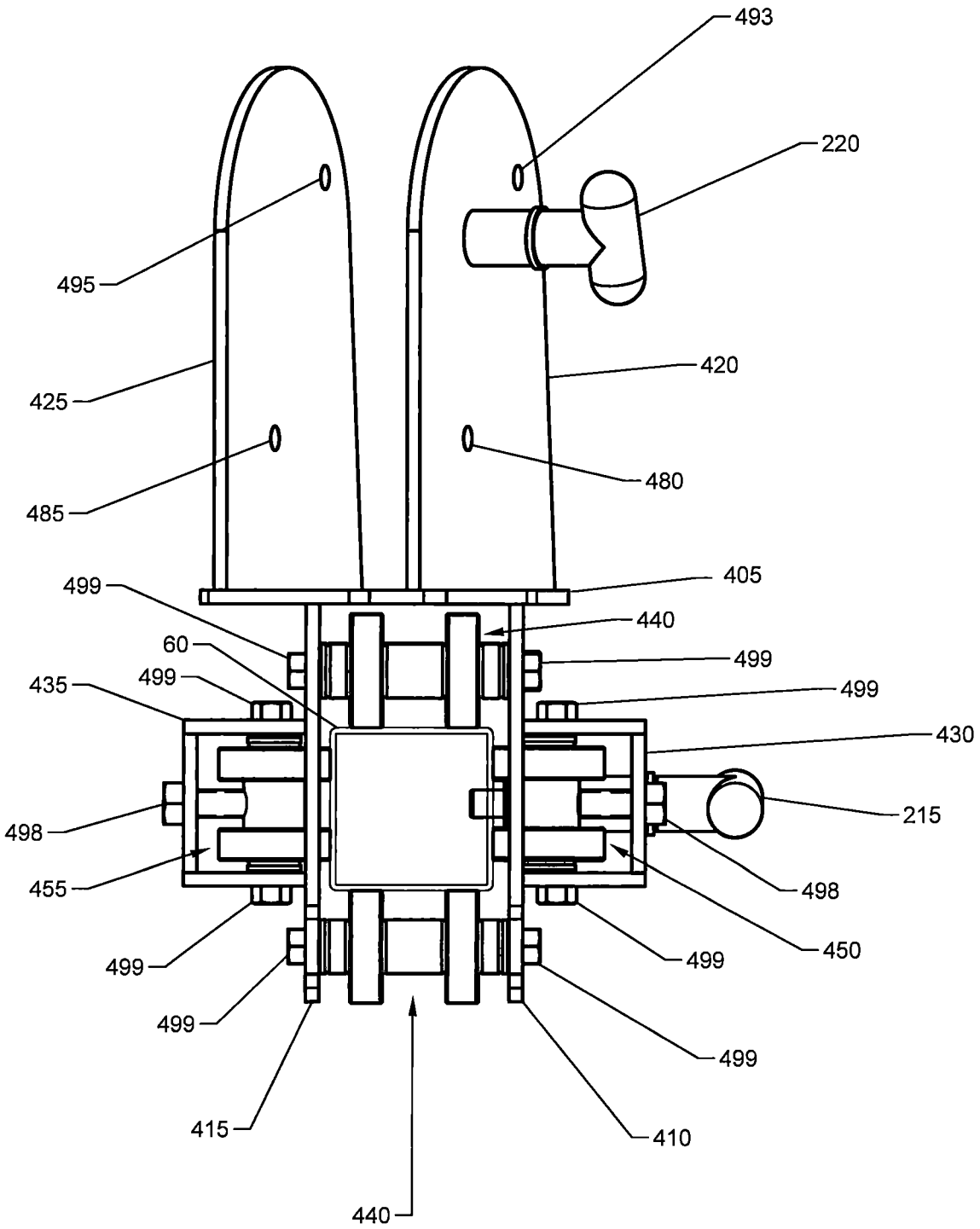
FIG. 31 is a top view of the left movable carriage assembly (400)

FIG. 31 left movable carriage assembly 400 of fitness machine of FIG. 1 top view.

Figure 32:
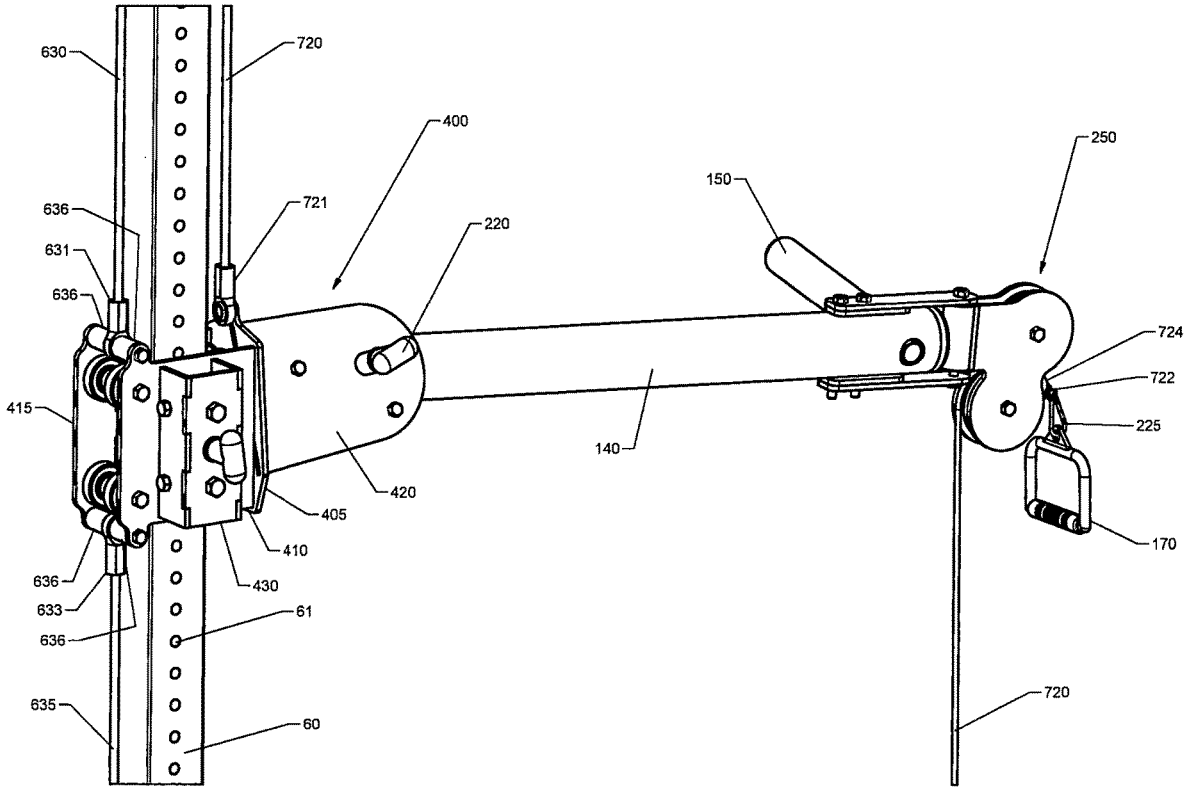
FIG. 32 is an enlarged side view of left movable carriage assembly (400) with left converging press arm (140) and left arm rotating pulley assembly (250)

FIG. 32 left movable carriage assembly 400 of fitness machine of FIG. 1 can have a pivotally attached left converging press arm 140 and left rotating arm pulley assembly 250.

Figure 33:
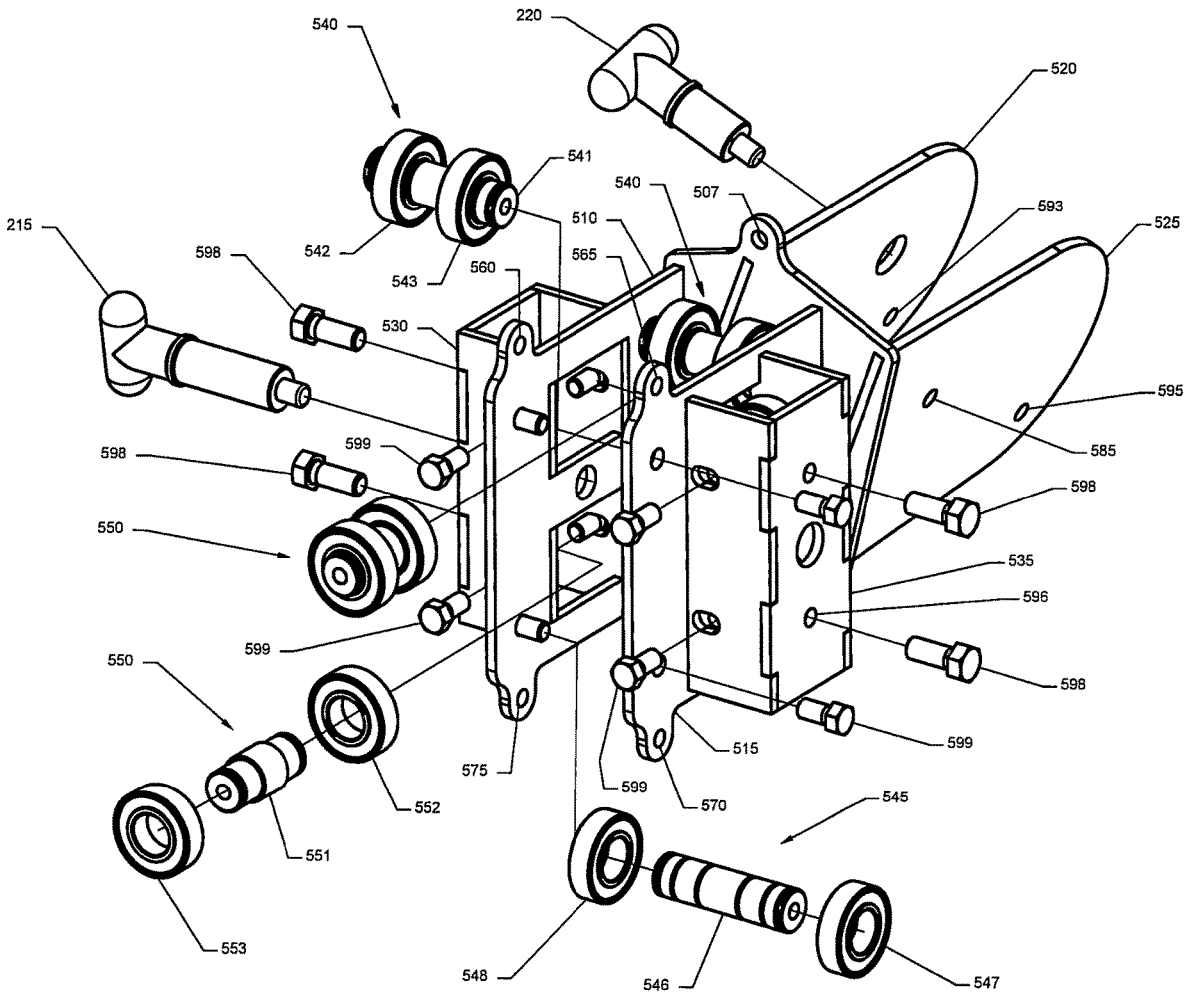
FIG. 33 is an enlarged exploded view of the right movable carriage assembly (500)
Figure 34:
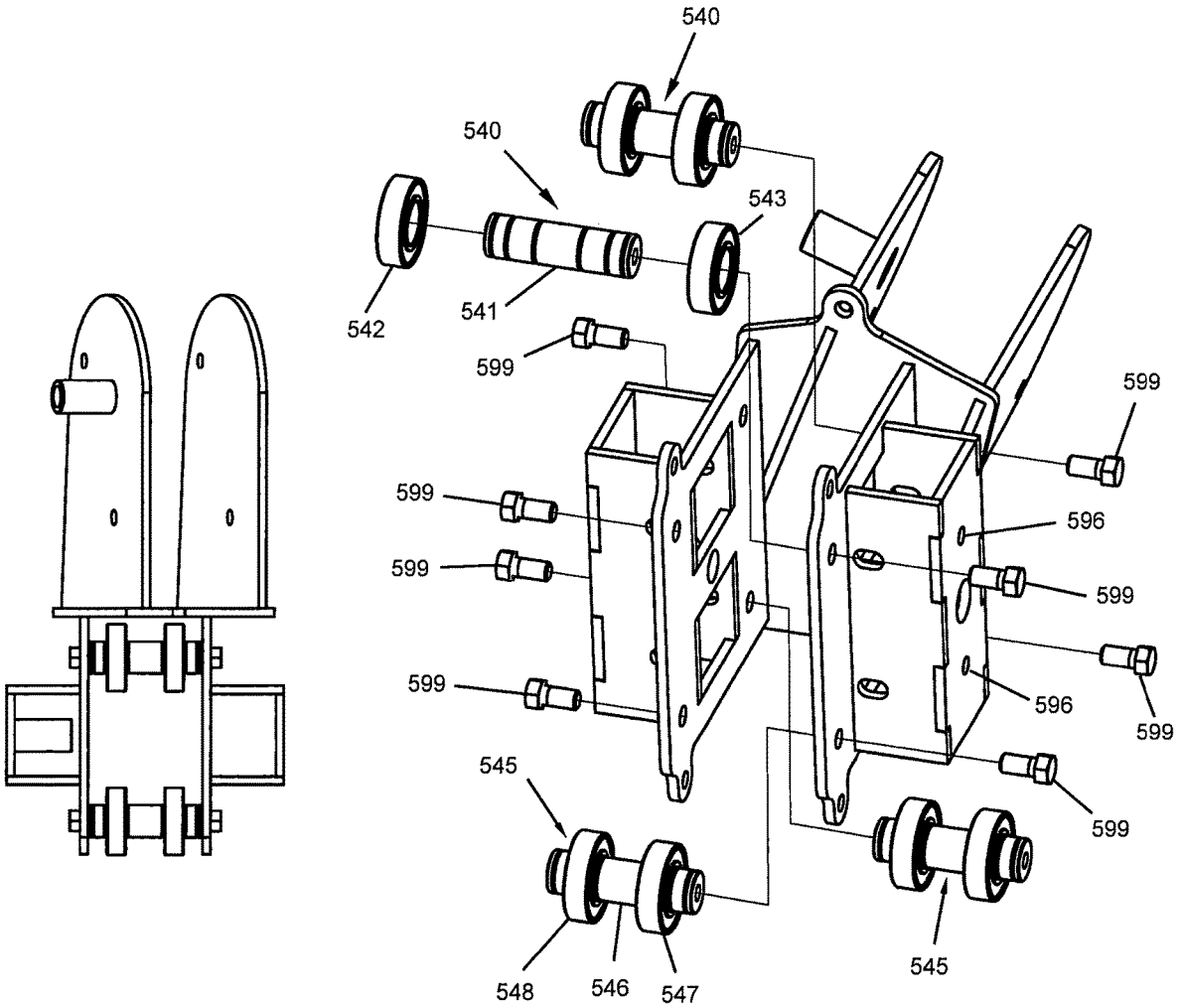
FIG. 34 is an enlarged exploded view of the right movable carriage assembly (500) upper main bearing wheel assembly (540) and lower main bearing wheel assembly (545)
Figure 35:
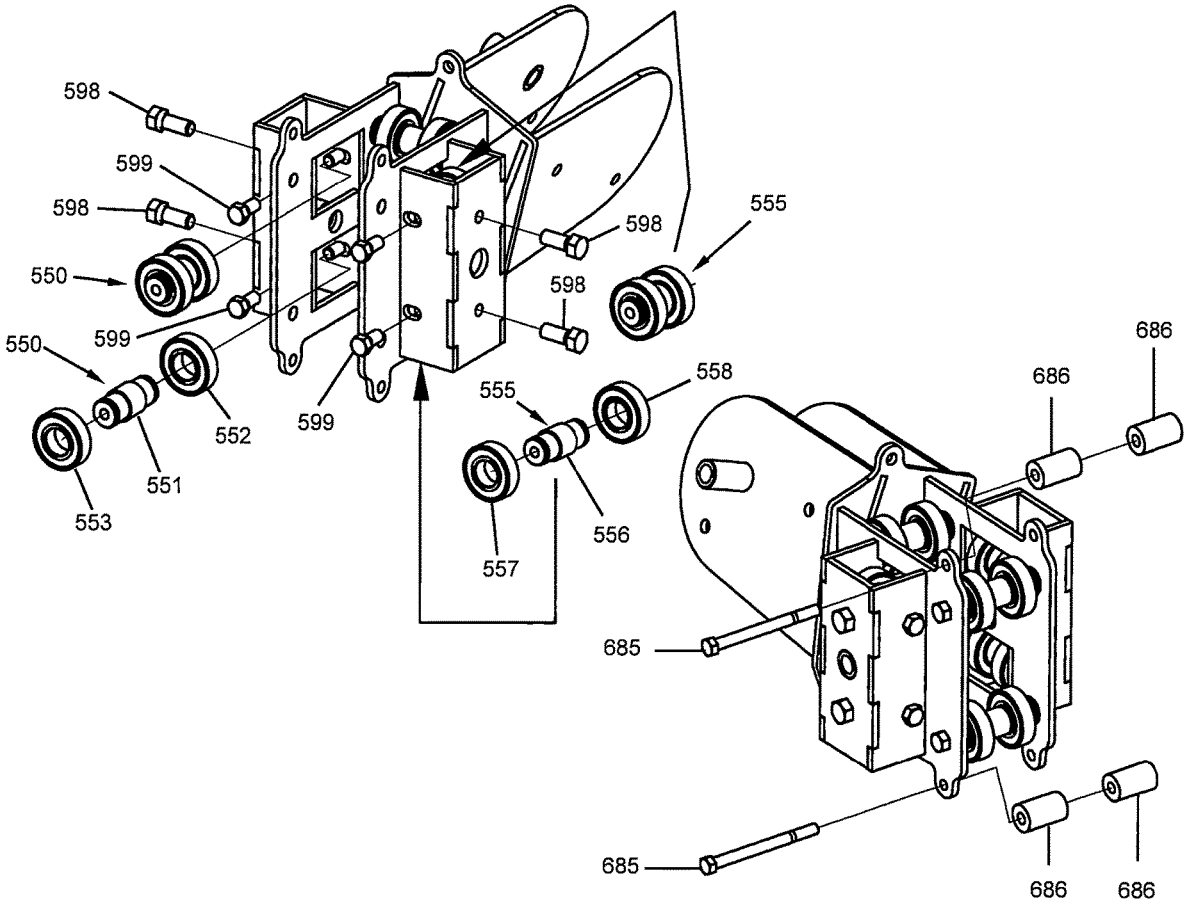
FIG. 35 is an enlarged exploded view of the right movable carriage assembly (500) right outwardly facing side bearing wheel assembly (550) and right inwardly facing bearing wheel assembly (555)

FIG. 33-35 right movable carriage assembly 500 of fitness machine of FIG. 1 can include a right outwardly facing carriage plate 510 and a right inwardly facing carriage plate 515 separated by and fixed in a parallel manner to the back side of right front carriage plate 505. Upper main bearing wheel assembly 540 and lower main bearing wheel assembly 545 can be fixably attached to the inside walls of carriage plate 510 and carriage plate 515 allowing for right movable carriage assembly 500 to ride upwards and downwards on vertically positioned selector tube 65.

Each of the upper main bearing wheel assembly 540 can be located on a front and rear side of vertically positioned selector tube 65 to allow for right movable carriage assembly 500 to easily roll upwards and downwards on vertically positioned selector tube 65. Each upper main bearing wheel assembly 540 can include a first wheel 542 and a second wheel 543 that are freely rotatable on shaft 541. Each of the lower main bearing wheel assembly 545 can be located on a front and rear side of vertically positioned selector tube 65 spaced under the top pair of upper main bearing wheel assemblies 540. Each lower main bearing wheel assembly 545 can include a first wheel 547 and a second wheel 548 that are freely rotatable on shaft 546.

Right outwardly facing carriage plate 510 can include a right outwardly facing bearing box 530 fixed on the outside wall of right outwardly facing carriage plate 510. Right outwardly facing bearing box 530 can have a fixably attached spring loaded pin 215. Additionally, each right outwardly facing side bearing wheel assembly 550 can be fixably attached in a vertical position inside right outwardly facing bearing box 530. The right outwardly facing side bearing wheel assemblies 550 can roll upwards and downwards on the right side of vertically positioned selector tube 65. Right outwardly facing bearing wheel assembly 550 can include a first wheel 552 and a second wheel 553 that are freely rotatable on shaft 551. Spring loaded pin 215 can be placed within a series of right selector hole(s) 66 allowing for height adjustments of right movable carriage assembly 500.

Right inwardly facing carriage plate 515 can include a right inwardly facing bearing box 535 fixed on the outside wall of right inwardly facing carriage plate 515. Additionally, each right inwardly facing side bearing wheel assembly 555 can be fixably attached in a vertical fashion inside right inwardly facing bearing box 535. The right inwardly facing side bearing wheel assemblies 555 can roll upwards and downwards on the left side of vertically positioned selector tube 65. Right inwardly facing side bearing wheel assembly 555 can have a first wheel 557 and a second wheel 558 that are freely rotatable on shaft 556.

Additionally, the front side of front carriage plate 505 can have a fixed parallelly placed equally angled right outwardly facing press arm plate 520 with a fixably attached spring loaded locking pin 220 and a right inwardly facing press arm plate 525. Spring loaded locking pin 220 can secure right converging press arm 145 and right arm rotating pulley assembly 300 into place while performing pushing, pulling and/or pressing exercises using right cable handle 175.

Right movable carriage assembly 500 can have a right converging press arm 145 pivotally mounted between right outwardly facing press arm plate 520 and right inwardly facing press arm plate 525. Converging press arm 145 can move toward the centerline of fitness machine of FIG. 1 when lifted upward and away from the centerline when lowered. Additionally, located between right outwardly facing press arm plate 520 and right inwardly facing press arm plate 525 can be a fixably attached right arm stopper 590. Right arm stopper 590 can act as a resting point for right converging press arm 145. Right converging press arm 145 can have a fixably attached inwardly facing handle 155. The outward end of right converging press arm 145 can have a fixably attached right arm rotating pulley system 300.

Figure 36:
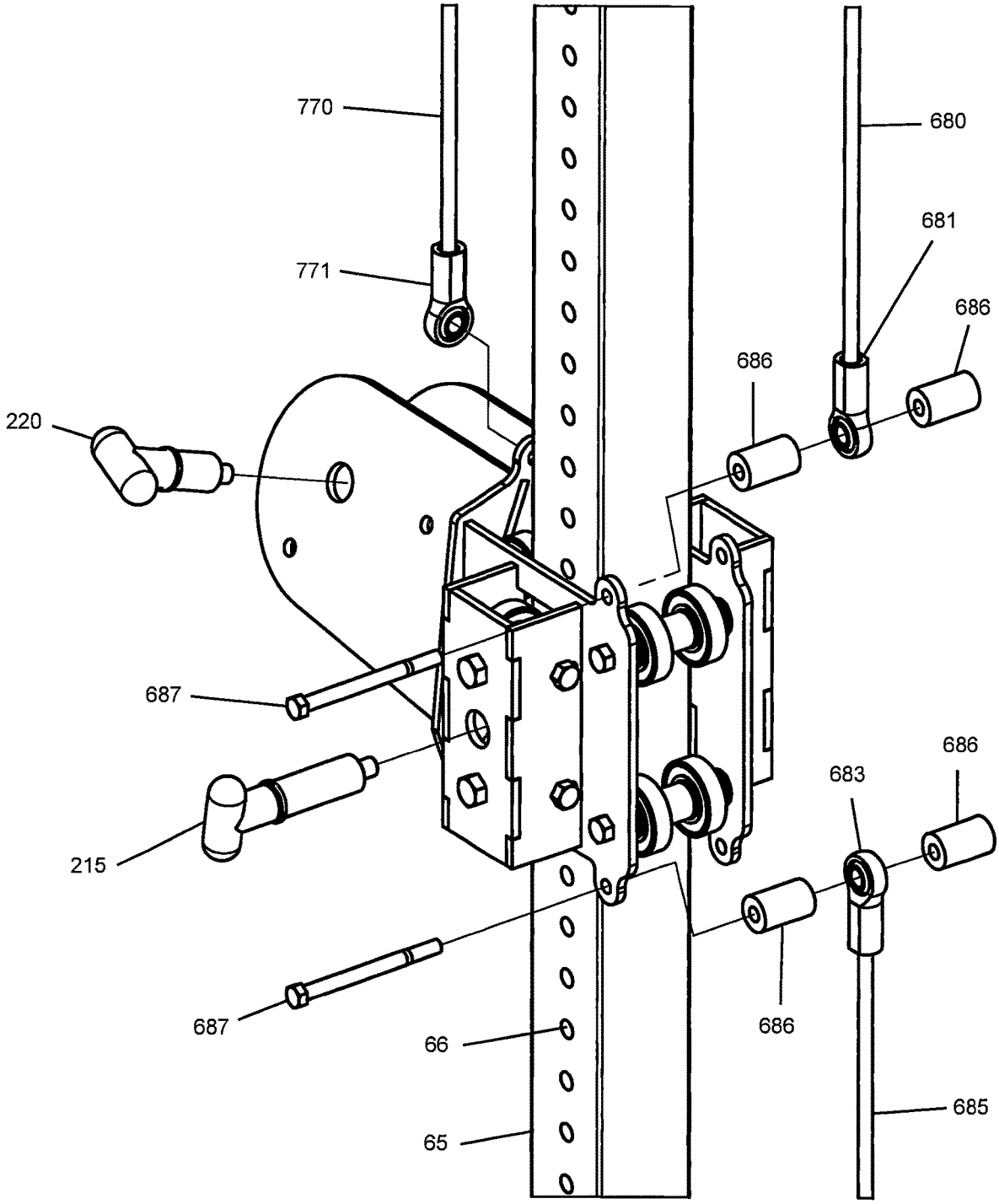
FIG. 36 is an enlarged view of the right movable carriage assembly (500) right weight stack cable (770) carriage attachment, right primary counter weight cable (680) carriage attachment and right secondary counter weight cable (685) carriage attachment

FIG. 36 right movable carriage assembly 500 of fitness machine of FIG. 1 can include a right primary counter weight cable 680 with fixably attached adjustable cable loop 681 centered between cable spacer(s) 686 and fixably attached to the upper rear of right movable carriage assembly 500 between right outwardly facing carriage plate upper tab 560 and right inwardly facing carriage plate upper tab 565. Similarly, right secondary counter weight cable 685 with fixably attached cable loop 683 can be entered between able spacer(s) 686 and fixably attached to the bottom rear of the right movable arm carriage assembly 500 between right outwardly facing carriage plate lower counter weight tab 570 and right inwardly facing carriage plate lower counter weight tab 575. Right weight stack cable 770 can have fixably attached weight stack cable adjustable loop 771 which can be fixably attached to right front carriage cable tab 507. Right movable carriage assembly 500 can be moved vertically on right selector tube 65 and can be secured into the desired right selector tube hole(s) 66 with fixably attached spring loaded pin 215.

Figure 37:
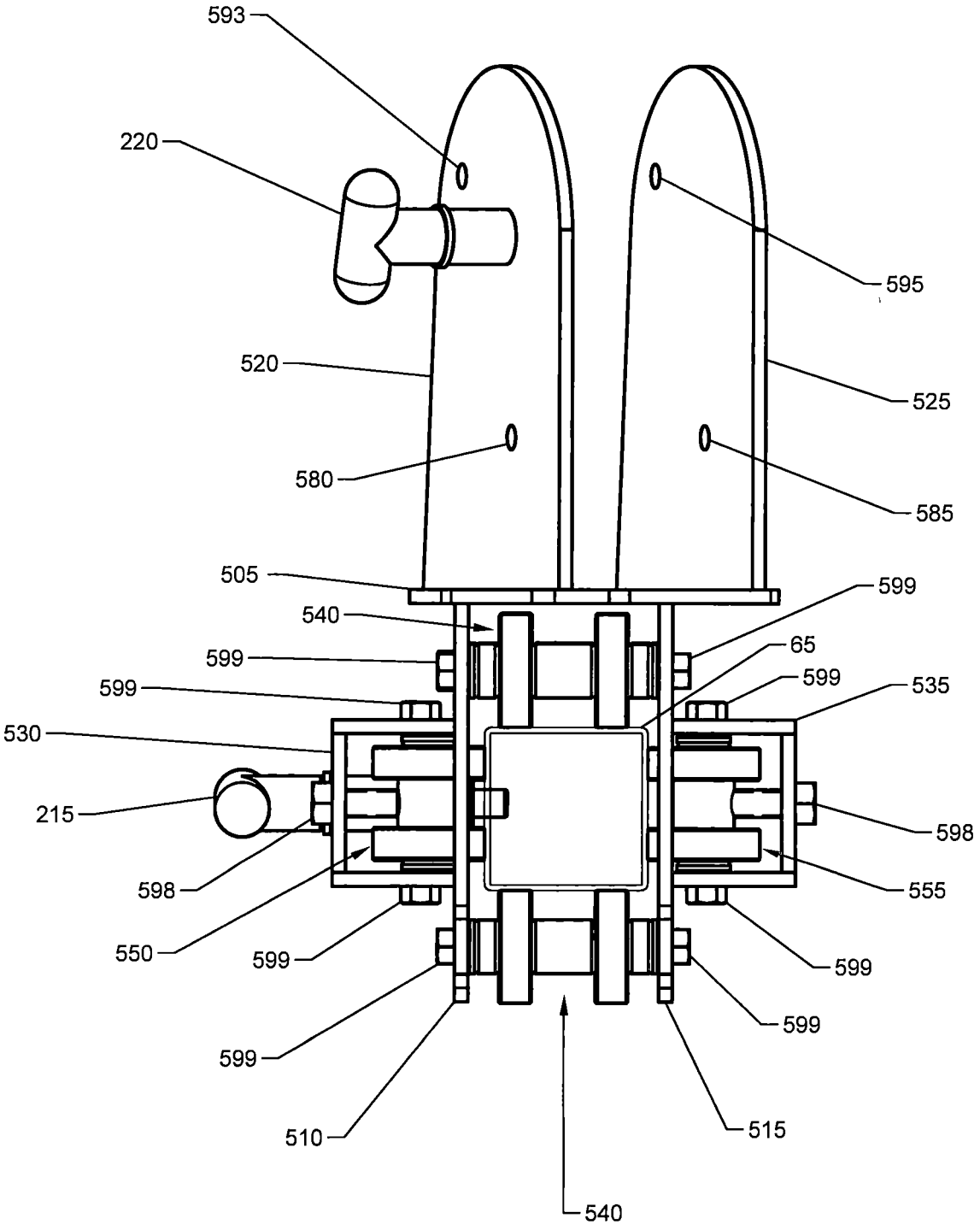
FIG. 37 is a top view of the right movable carriage assembly (500)

FIG. 37 right movable carriage assembly 500 of fitness machine of FIG. 1 top view.

Figure 38:
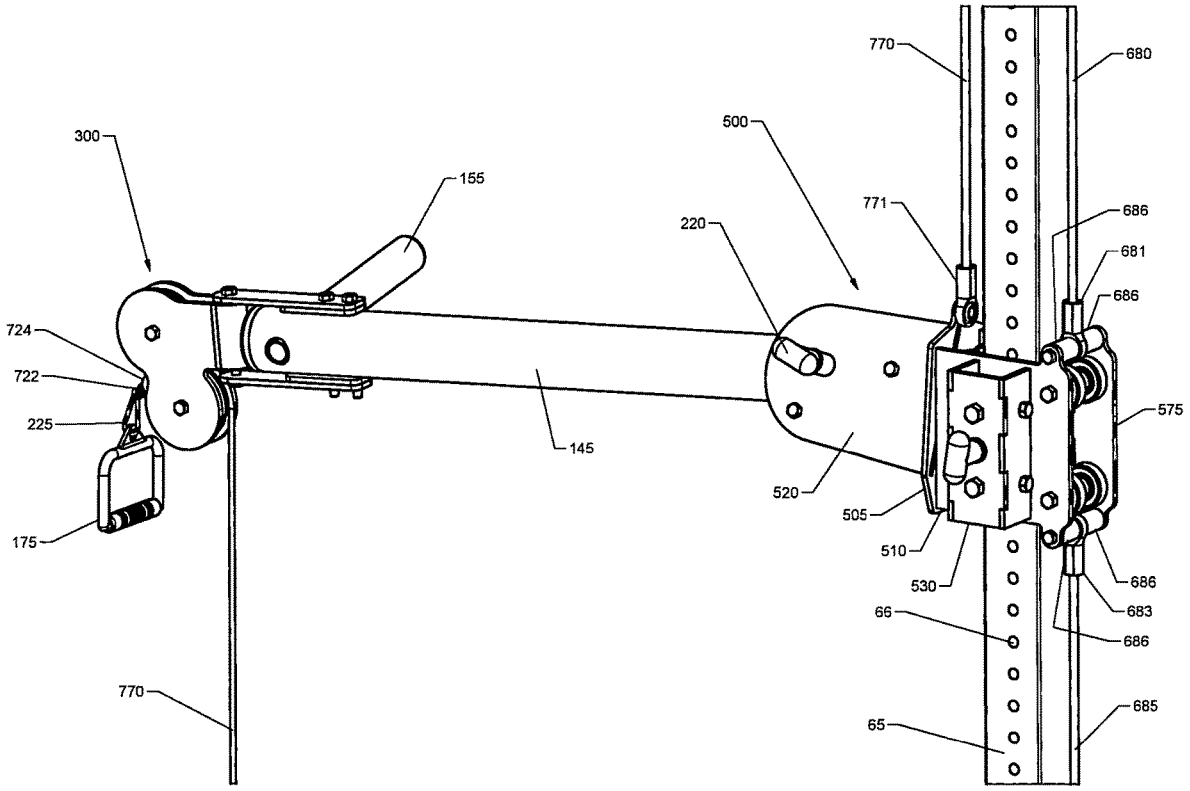
FIG. 38 is an enlarged side view of right movable carriage assembly (500) with right converging press arm (145) and right arm rotating pulley assembly (300)

FIG. 38 right movable carriage assembly 500 of fitness machine of FIG. 1 can have a pivotally attached right converging press arm 145 and right rotating arm pulley assembly 300.

While the preferred embodiments describe parts of the fitness machine of FIG. 1 being fixably attached to one another, this term can include but is not limited to parts bolted together, screwed together, welded together, pressed together, pinned together and any combination thereof.

What makes the fitness machine of FIG. 1 unique is that the left press converging arm 140 and the right converging press arm 145 are fully adjustable for height to perform a wide variety of exercises. This is accomplished through the left movable arm carriage assembly 400 and the right movable arm carriage assembly 500 and the ability to be used with or without any adjustable bench or fixed bench common to fitness facilities.

Another unique feature of the fitness machine of FIG. 1 are the independently adjustable left converging press arm 140 and Independently adjustable right converging press arm 145 allowing for multiple pressing and pulling exercises to be performed from one platform while maintaining biomechanical exercise correctness.

Another unique feature of the fitness machine of FIG. 1 is the use of counter weight assembly 600 neutralizing the weight of left movable carriage 400, left converging arm 140 and left rotating pulley assembly 250 allowing for near weightless vertical adjustments of left movable carriage 400. Similarly, the use of counter weight assembly 650 neutralizing the weight of right movable carriage assembly 500, right converging arm 145 and right rotating pulley assembly 300 allowing for near weightless vertical adjustments of right movable carriage assembly 500.

Another unique feature of the fitness machine of FIG. 1 is the use of left arm rotating pulley assembly 250 and left foot rotating pulley assembly 90. These assemblies in coordination with left movable carriage assembly 400 and left converging press arm 140 allow for the performance of numerous multi height cable pulley exercises using left cable handle 170 while maintaining the upwardly pivoting abilities of left converging press arm 140. Similarly, the use of right arm rotating pulley assembly 300 and right foot rotating pulley assembly 100 in coordination with right movable carriage assembly 500 and right converging press arm 145 allow for the performance of numerous multi height cable pulley exercises using right cable handle 175 while maintaining the upwardly pivoting abilities of right converging press arm 145.

Another unique feature of the fitness machine of FIG. 1 is the ability to adjust left movable carriage assembly 400 and right movable carriage assembly 500 vertically to the desired height of the user. This vertical adjustment capability allows for diverse exercise variability and function.

Another unique feature of the fitness machine of FIG. 1 is the ability to host multiple users simultaneously with the independently adjustable movable carriage assembly 400 and movable carriage assembly 500.

Although specific advantages have been enumerated above, various embodiment may include some, none or all of the enumerated advantages.

Other technical advantages may become readily apparent to one of ordinary skill in the art after review of the following figures and descriptions.

It should be understood at the outset that, although exemplary. embodiments are illustrated in the figures and described below, the principals of the present disclosure may be implemented using any number of techniques, whether currently known or not. The present disclosure should be in no way limited to the exemplary implementations and techniques illustrated in the drawings and described below.

Unless otherwise specifically noted, articles depicted in drawings are not necessarily drawn to scale.

Modifications, additions or omissions may be made to the systems, apparatuses and methods described herein without departing from the scope of the disclosure. For example, the components of the systems and apparatuses may be integrated or separated. Moreover, the operations of the systems and apparatuses disclosed herein may be performed by more, fewer or other steps. Additionally, steps may be performed in any suitable order.

As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "steps for" are explicitly used in the particular claim. The term "approximately" is similar to the term "about" and can be +/−10% of the amount referenced.

Additionally, preferred amounts and ranges can include the amounts and ranges referenced without the prefix of being approximately.

While the invention has been described, disclosed, illustrated and shown in various terms of certain embodiments or modifications which it has been presumed in practice, the scope of the invention is not intended to be, nor should it be deemed to be, limited thereby and such other modifications or embodiments as may be suggested by the teachings herein are particularly reserved especially as they fall within the breadth and scope of the claim here appointed.

The invention claimed is:

1. A weight press and cable exercise system, comprising:

a left frame and a right frame being parallel to each other and each having a front side, a rear side, a top side, and a bottom side;

a left vertical member and a right vertical member being parallel to each other and respectively attached to the left and right frames within the front side of each frame, respectively, each of the left and right vertical members having an upper end and a lower end;

a left horizontal member and a right horizontal member being parallel to each other and adjacent to a ground surface, each of the left and right horizontal members having a front end and a rear end, the rear ends of left and right horizontal members being respectively attached to the left and right frames within the front side of each frame and respectively at the lower ends of the left and right vertical members;

a top rear perpendicular member attached to and between the left and right frames within the rear side of each frame and near the top side of each frame;

a bottom rear perpendicular member attached to and between the left and right frames within the rear side of each frame and near the bottom side of each frame;

a top front perpendicular member having handles and being attached to and between the left and right frames within the front side of each frame and near the top side of each frame;

a left movable carriage assembly and a right movable carriage assembly for respectively sliding up and down on the left and right vertical members;

a left pivotal arm and a right pivotal arm being spaced apart from each other, each of the left and right pivotal arms having an outer end and an inner end, the inner ends of the left and right pivotal arms being respectively pivotally attached to the left and right movable carriage assemblies;

a left foot rotating pulley assembly and a right foot rotating pulley assembly respectively coupled to the front ends of the left and right horizontal members;

a left arm rotating pulley assembly and a right arm rotating pulley assembly respectively coupled to the outer ends of the left and right pivotal arms;

a left grip and a right grip respectively adjacent to the outer ends of the left and right pivotal arms;

a left weight stack and a right weight stack respectively contained within the left and right frames;

a left weight stack cable and a left series of weight stack pulleys respectively attaching the left weight stack to the left pivotal arm, and a right weight stack cable and a right series of weight stack pulleys respectively attaching the right weight stack to the right pivotal arm, wherein different amounts of resistance are allowed to be placed on the left and right weight stacks;

a left arm cable handle and a right arm cable handle respectively attached to the left and right weight stack cables at the left and right arm rotating pulley assemblies, wherein the left and right arm cable handles are adapted to be respectively pushed, pulled, and/or pressed away from the left and right arm rotating pulley assemblies by a user;

a left counter weight and a right counter weight respectively contained within the left and right frames;

left counter weight cables and a left series of counter weight pulleys respectively attached to the left movable carriage assembly to neutralize a weight of the left movable carriage assembly, and right counter weight cables and a right series of counter weight pulleys respectively attached to the right movable carriage assembly to neutralize a weight of the right movable carriage assembly; and a left adjustable mount and a right adjustable mount for respectively prepositioning the left and right movable carriage assemblies at selected fixed height levels between the lower end and the upper end of the left and right vertical members, respectively;

wherein the left and right grips are adapted to be gripped by the user positioned between the left and right pivotal arms in order to respectively push up and lower down the left and right pivotal arms to perform exercises at different ranges based on an initial fixed position of the left and right movable carriage assemblies.

2. The weight press and cable exercise system of claim 1, wherein the left and right pivotal arms having an initial horizontal position.

3. The weight press and cable exercise system of claim 1, wherein the left and right pivotal arms converge together when moved upward.

4. The weight press and cable exercise system of claim 1, wherein the left and right pivotal arms are independently moveable from one another.

5. The weight press and cable exercise system of claim 1, wherein the left and right movable carriage assemblies are independently movable from one another.

6. The weight press and cable exercise system of claim 1, wherein the left and right grips arms extend inward toward each other.

7. The weight press and cable exercise system of claim 1, wherein the left and right arm rotating pulley assemblies respectively extend forward from the outer ends of the left and right pivotal arms.

8. The weight press and cable exercise system of claim 7, wherein the left arm rotating pulley assembly rotates to follow the left foot rotating pulley assembly, and wherein the right arm rotating pulley assembly rotates to follow the right foot rotating pulley assembly.

9. The weight press and cable exercise system of claim 1, wherein the left and right foot rotating pulley assemblies respectively extend forward from the front ends of the left and right horizontal members extending forward from each leg.

10. The weight press and cable exercise system of claim 9, wherein the left foot rotating pulley assembly rotates to follow the left arm rotating pulley assembly, and wherein the right foot rotating pulley assembly rotates to follow the right arm rotating pulley assembly.

11. The weight press and cable exercise system of claim 1, further comprising a left fastening member and a right fastening member for respectively attaching the left and right movable carriage assemblies to the left and right vertical members.

12. The weight press and cable exercise system of claim 1, wherein the left and right adjustable mounts each comprise:

a plurality of vertically spaced apart openings between the lower end and the upper end of the corresponding vertical member; and a pin for locking the corresponding movable carriage assembly to a selected one of the plurality of vertically spaced apart openings.

13. The weight press and cable exercise system of claim 1, wherein:

the left and right counter weight cables each comprise a first flexible line and a second flexible line, each of the first and second flexible lines having a first end and a second end;

the left and right series of counter weight pulleys each comprise a top series of pulleys and a bottom series of pulleys;

the first end of the first flexible line being attached to a top rear portion of the corresponding movable carriage assembly and the second end of the first flexible line passing around the corresponding top series of pulleys and being attached to a top of the corresponding counter weight;

the first end of the second flexible line being attached to a bottom rear portion of the corresponding movable carriage assembly and the second end of the second flexible line passing around the corresponding bottom series of pulleys and being attached to a bottom of the corresponding counter weight; and the left and right counter weights respectively allowing for the left and right movable carriage assemblies to be easily positioned to the selected fixed height levels.

14. The weight press and cable exercise system of claim 13, wherein each of the first and second flexible lines comprises a nylon encased steel cable.

15. The weight press and cable exercise system of claim 1, wherein:

the left and right weight stack cables each comprise a flexible line having a first end and a second end;

the first end of the flexible line being attached to a top front portion of the corresponding movable carriage assembly and the second end of the flexible line passing around the corresponding series of weight stack pulleys and being attached to a front of the corresponding arm rotating pulley assembly; and the left and right weight stacks respectively allowing for a selection of the different amounts of resistance.

16. The weight press and cable exercise system of claim 13, wherein the flexible line comprises a nylon encased steel cable.

17. The weight press and cable exercise system of claim 16, wherein:

a pair of guide rods is attached to each of the left and right frames;

the left and right weight stacks each comprises a plurality of weight stack plates each having side holes therein; and the side holes allowing the corresponding plurality of weight stack plates to slide up and down the corresponding pair of guide rods when the corresponding pivotal arm is lifted or the corresponding arm cable handle is pushed, pulled, and/or pressed.

18. The weight press and cable exercise system of claim 17, where in a pin is used to select the different amounts of resistance.

19. The weight press and cable exercise system of claim 1, further comprising a bearing assembly attached to each of the left and right movable carriage assemblies for allowing the corresponding movable carriage assembly to slide up and down on the corresponding vertical member.

20. The weight press and cable exercise system of claim 19, wherein each bearing assembly comprises:

front side bearings for allowing the corresponding movable carriage assembly to slide up and down on the front side of the corresponding vertical member;

rear side bearings for allowing the corresponding movable carriage assembly to slide up and down on the rear side of the corresponding vertical member;

left side bearings for allowing the corresponding movable carriage assembly to slide up and down on a left side of the corresponding vertical member; and right side bearings for allowing the corresponding movable carriage assembly to slide up and down on a right side of the corresponding vertical member.

21. The weight press and cable exercise system of claim 19, wherein each bearing assembly comprises rotatable wheels on axles for allowing the corresponding movable carriage assembly to slide up and down on the corresponding vertical member.

* * * * *